US007002568B2

(12) United States Patent
Morita

(10) Patent No.: US 7,002,568 B2
(45) Date of Patent: Feb. 21, 2006

(54) SIGNAL DRIVE CIRCUIT, DISPLAY DEVICE, ELECTRO-OPTICAL DEVICE, AND SIGNAL DRIVE METHOD

(75) Inventor: Akira Morita, Suwa (JP)

(73) Assignee: Seiko Epson Corporation, (JP)

( * ) Notice: Subject to any disclaimer, the term of this patent is extended or adjusted under 35 U.S.C. 154(b) by 232 days.

(21) Appl. No.: 10/154,480

(22) Filed: May 23, 2002

(65) Prior Publication Data

US 2002/0190973 A1 Dec. 19, 2002

(30) Foreign Application Priority Data

May 24, 2001 (JP) ..... 2001-155193

(51) Int. Cl.
*G09G 5/00* (2006.01)

(52) U.S. Cl. ..... 345/211; 345/87

(58) Field of Classification Search ..... 345/204, 345/87–100, 211

See application file for complete search history.

(56) References Cited

U.S. PATENT DOCUMENTS

| | | | | |
|---|---|---|---|---|
| 5,710,576 | A * | 1/1998 | Nishiyama et al. | 345/169 |
| 5,859,630 | A | 1/1999 | Huq | 345/100 |
| 6,130,657 | A | 10/2000 | Kurokawa et al. | |
| 6,262,704 | B1 | 7/2001 | Durumisawa et al. | |
| 6,323,849 | B1 * | 11/2001 | He et al. | 345/204 |
| 6,380,917 | B1 * | 4/2002 | Matsueda et al. | 345/89 |
| 6,384,806 | B1 * | 5/2002 | Matsueda et al. | 345/89 |
| 6,392,354 | B1 * | 5/2002 | Matsueda | 315/169.1 |
| 6,597,119 | B1 * | 7/2003 | Ito | 315/169.1 |
| 6,674,420 | B1 * | 1/2004 | Matsueda et al. | 345/87 |
| 6,674,422 | B1 * | 1/2004 | Ozawa | 345/98 |
| 6,731,266 | B1 | 5/2004 | Jung | 345/103 |
| 2001/0035862 | A1 * | 11/2001 | Nakamura et al. | 345/204 |
| 2002/0190971 | A1 * | 12/2002 | Nakamura et al. | 345/204 |

FOREIGN PATENT DOCUMENTS

| | | | |
|---|---|---|---|
| CN | 1240043 A | | 11/1997 |
| CN | 1246698 A | | 3/2000 |
| JP | 05-072992 | | 3/1993 |
| JP | 10-282939 | | 10/1998 |
| JP | 2000-181414 | | 6/2000 |
| JP | 02002099262 | * | 4/2002 |
| JP | 02003167559 | * | 6/2003 |
| WO | WO97/22036 | | 6/1997 |

OTHER PUBLICATIONS

Communication from Korean Patent Office re: counterpart application.
Communication from China re: counterpart application.
Communication from Japanese Patent Office re: related application.

* cited by examiner

*Primary Examiner*—Alexander Eisen
(74) *Attorney, Agent, or Firm*—Harness, Dickey & Pierce, P.L.C.

(57) ABSTRACT

A signal drive circuit for an active matrix type liquid crystal panel. This signal drive circuit comprises: a shift register for shifting image data sequentially on a block basis, each block constituting a plurality of signal lines, to correspond to signal lines of a block; a line latch for latching the image data in synchronization with a horizontal synchronizing signal; a drive voltage generation circuit for generating drive voltages based on the image data; and a signal line drive circuit. This signal driver controls a partial display based on the partial display data which is designated on a block basis. Each of the signal lines in a block set as a display area is driven based on the image data. Each of the signal lines in a block set as a non-display area is driven by a predetermined non-display level voltage generated by a non-display level voltage supply circuit.

11 Claims, 21 Drawing Sheets

BLOCK WHERE PARTIAL DISPLAY DATA IS SET ON

BLOCK WHERE PARTIAL DISPLAY DATA IS SET OFF

FIG. 12A SHL = "H"
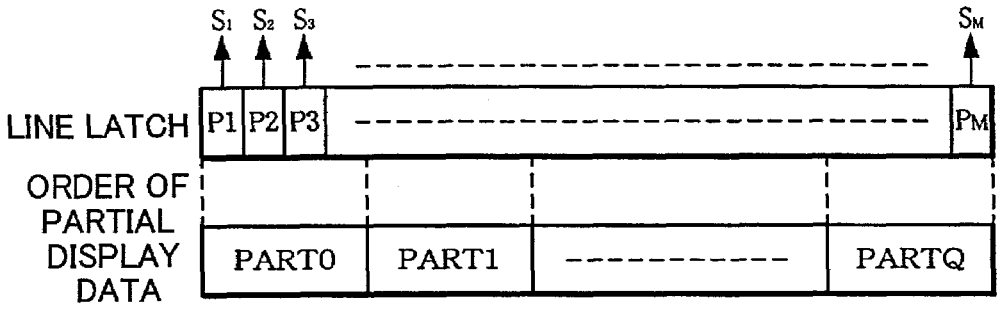
FIG. 12B SHL = "L"
ORDER OF DATA IS NOT CHANGED
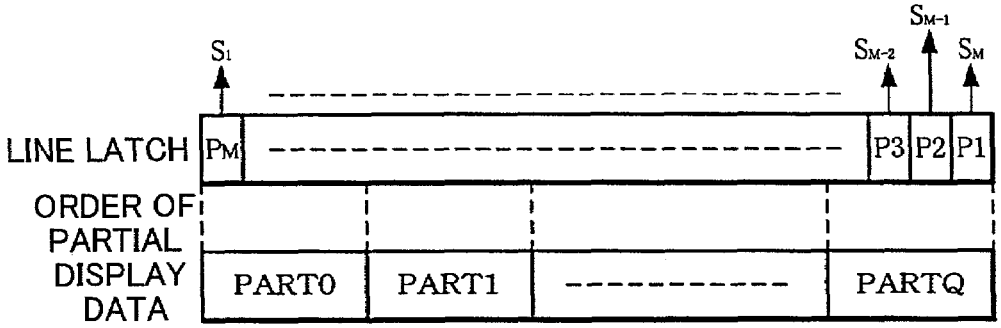
FIG. 12C SHL = "L"
ORDER OF DATA IS CHANGED
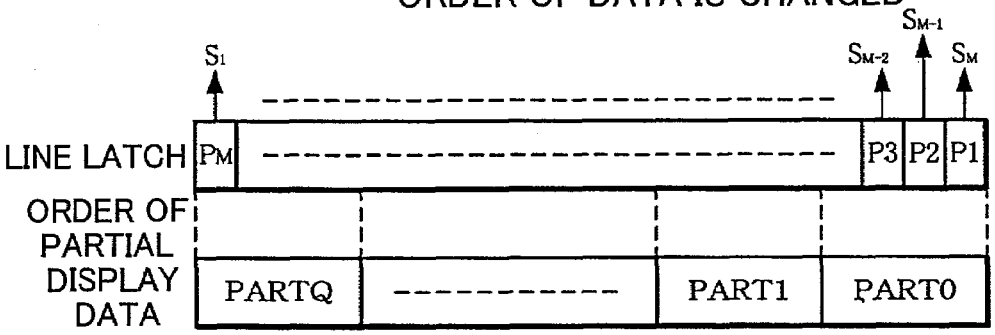

CONSTRUCTION OF SIGNAL DRIVER (AT BLOCK UNIT)

REFERENCE VOLTAGE SELECT SIGNAL GENERATION

NON-DISPLAY-LEVEL VOLTAGE SUPPLY

SIGNAL DRIVE CIRCUIT, DISPLAY DEVICE, ELECTRO-OPTICAL DEVICE, AND SIGNAL DRIVE METHOD

Japanese Patent Application No. 2001-155193 filed on May 24, 2001 is hereby incorporated by reference in its entirety.

TECHNICAL FIELD

The present invention relates to a signal drive circuit, and a display device, an electro-optical device and a signal driving method using the circuit.

BACKGROUND

In a display section of an electronic device such as a mobile telephone, there is used a liquid crystal panel for lowering the power consumption and for reducing the size and weight of the electronic device. For this liquid crystal panel, there has been an increasing demand for a higher image quality, as a still or moving image carrying much information is distributed with the wide spreading of mobile telephones in the recent years.

As the liquid crystal panel for realizing the high image quality of the display section of the electronic device, there is known an active matrix type liquid crystal panel using a thin film transistor (TFT) liquid crystal. This active matrix type liquid crystal panel using the TFT liquid crystal is suitable for realizing a high-speed response and a high contrast and for displaying moving images compared to the simple matrix type liquid crystal panel using the STN (Super Twisted Nematic) liquid crystal by the dynamic drive.

SUMMARY

According to one embodiment of the present invention, there is provided a signal drive circuit for driving a plurality of signal lines of an electro-optical device which includes a plurality of pixels defined by a plurality of scan lines and the signal lines crossing each other, based on image data comprising:

a line latch for latching the image data for a horizontal scan period;

a drive voltage generating section for generating drive voltages of the signal lines based on the image data latched by the line latch;

a signal line drive section for driving the signal lines based on the drive voltages generated by the drive voltage generating section; and a partial display data holding section for holding partial display data which indicates propriety of output of the drive voltages to the signal lines on a block basis, each block constituting a predetermined number of signal lines, wherein the signal line drive section controls the output of the drive voltages to the signal lines on a block basis based on the partial display data.

According to another embodiment, there is provided a display device comprising: a display panel including a plurality of pixels defined by a plurality of scan lines and a plurality of signal lines crossing each other; a scan drive circuit for scanning and driving the scan lines; and a signal drive circuit for driving the signal lines based on image data.

According to still another embodiment, there is provided an electro-optical device comprising: a plurality of pixels defined by a plurality of scan lines and a plurality of signal lines crossing each other; a scan drive circuit for scanning and driving the scan lines; and a signal drive circuit for driving the signal lines based on image data.

According to a further embodiment, there is provided a signal drive method for a signal drive circuit driving a plurality of signal lines of an electro-optical device including pixels which are defined by a plurality of scan lines and the signal lines crossing each other, comprising the steps of:

latching the image data for a horizontal scan period;

generating drive voltages for each of the signal lines based on the latched image data; and holding partial display data which indicates the propriety of the output of the drive voltages to the signal lines on a block basis, each block constituting a predetermined number of signal lines, wherein the output of the drive voltages to the signal lines is controlled on a block basis based on the partial display data.

BRIEF DESCRIPTION OF THE SEVERAL VIEWS OF THE DRAWINGS

FIGS. 12A, 12B and 12C are explanatory diagrams schematically showing the corresponding relationship between image data latched in line latches and blocks;

DETAILED DESCRIPTION

Figure 1:
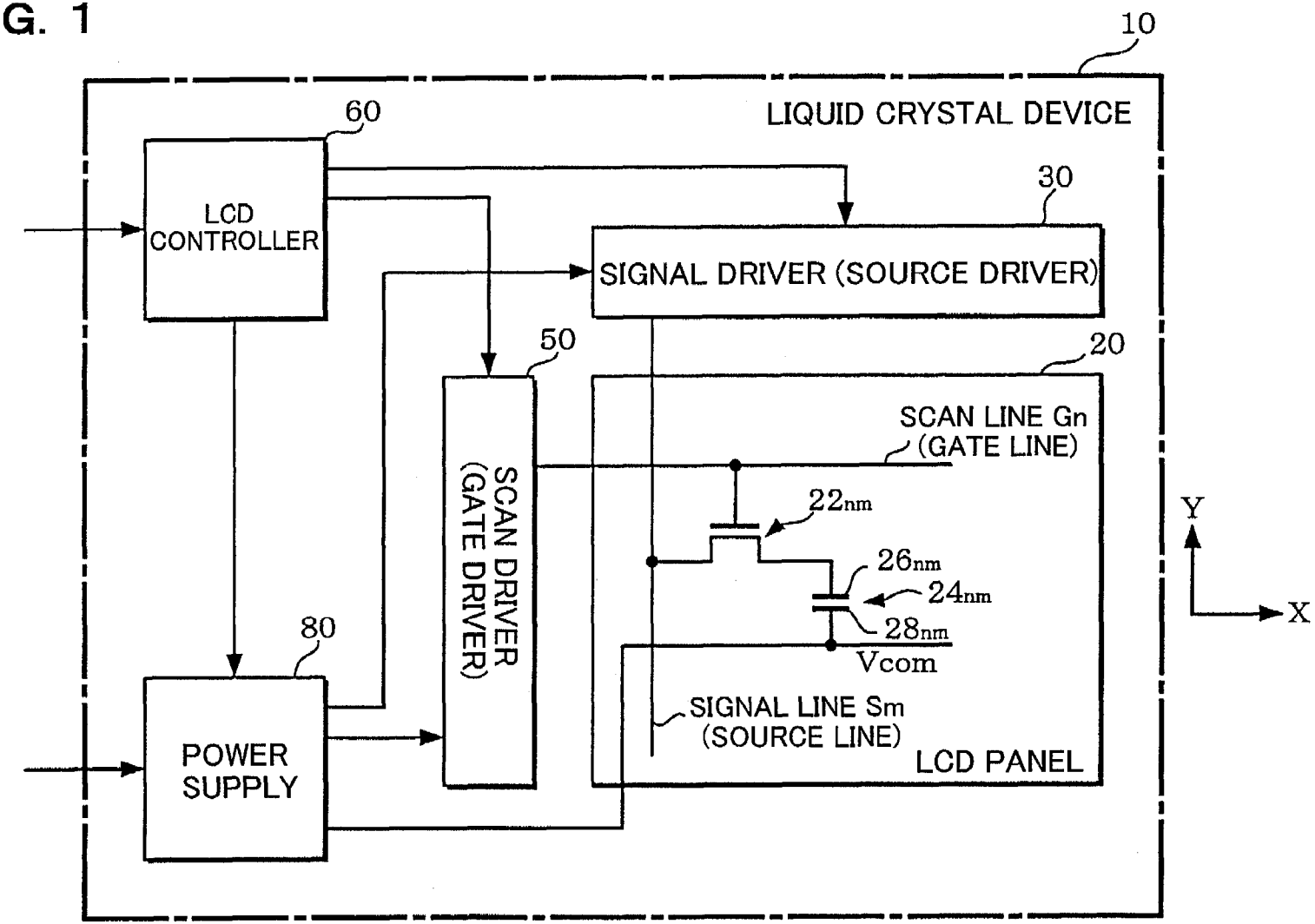
FIG. 1 is a block diagram schematically showing the construction of a display device, to which a signal drive circuit (or a signal driver) according to an embodiment of the invention is applied.

The present invention will be described in connection with its embodiment.

Here, the embodiment to be described does not limit the contents of the invention, as defined in the scope of claims. Moreover, all the constructions to be described in the following embodiment are not essential for the construction of the invention.

Here, it has been difficult to adopt an active matrix type liquid crystal panel using the TFT liquid crystal as the display section of a battery-driven mobile type electronic device such as a mobile telephone having a high power consumption.

The following embodiment has been made in view of the technical problem thus far described, and can make a high image quality and a low power consumption compatible to provide a signal drive circuit suitable for the active matrix type liquid crystal panel, and a display device, an electro-optical device and a signal drive method using the signal drive circuit.

According to one embodiment, there is provided a signal drive circuit for driving a plurality of signal lines of an electro-optical device which includes a plurality of pixels defined by a plurality of scan lines and the signal lines crossing each other, based on image data comprising: a line latch for latching the image data for a horizontal scan period; a drive voltage generating section for generating drive voltages of the signal lines based on the image data latched by the line latch; a signal line drive section for driving the signal lines based on the drive voltages generated by the drive voltage generating section; and a partial display data holding section for holding partial display data which indicates the propriety of the output of the drive voltages to the signal lines on a block basis, each block constituting a predetermined number of signal lines, wherein the signal line drive section controls the output of the drive voltage to the signal lines on a block basis based on the partial display data.

Here, the electro-optical device may also include: a plurality of scan lines and a plurality of signal lines crossing each other; switching sections connected with the scan lines and the signal lines; and pixel electrodes connected with the switching sections.

Moreover, the signal lines to be divided in blocks may be either a plurality of signal lines adjoining each other or a plurality of signal lines selected arbitrarily.

The output control of the drive voltages of the signal lines is to control whether or not the signal lines are to be driven with the drive voltages generated on the basis of the image data, or to drive the signal lines with predetermined voltages in place of the drive voltages, for example.

According to the embodiment, the signal drive circuit for driving the signal lines of the electro-optical device based on the image data comprises: a partial display data holding section for holding partial display data which indicates the propriety of the output of the drive voltages to the signal lines based on the image data on a block basis, each block constituting a predetermined number of signal lines. Based on the partial display data designated on a block basis, the output of the drive voltages to be supplied to the signal lines is controlled on a block basis so that partial display control can be incorporated arbitrarily. As a result, it is possible to reduce the power consumption by the signal drive of the non-display area.

According to the embodiment, the signal drive circuit may further comprise: a shift register for shifting the sequentially supplied image data to supply the image data to the line latch per horizontal scan unit; a shift direction switching section for switching the shift direction of the shift register based on a predetermined shift direction switching signal; and a data interchange section for interchanging the order of the partial display data which is held in the partial display data holding section on a block basis based on the predetermined shift direction switching signal. In this case, the signal line drive section controls the output of the drive voltages of the signal lines on a block basis based on the partial display data supplied from the data interchange section.

Here, the shift direction of the shift register is the shift direction in which the image data to be inputted at a predetermined unit is fetched by the shift register, when the image data is latched in the line latch per horizontal scan unit.

Thus, by using a shift direction switching signal for inputting the image data by switching the shift direction according to the packaged state, the order of the partial display data indicating whether or not the signal lines are to be driven based on the image data for each block is reversed. Therefore, the user may supply the image data to the signal drive circuit according to the embodiment without considering the order of the data according to the packaged state. In this way, the user may find the signal drive circuit convenient and this may contribute to reducing the number of developing steps.

In the embodiment, moreover, the signal line drive section may include: an impedance conversion section for subjecting the drive voltages generated by the drive voltage generating section to impedance conversion to output the impedance-converted drive voltages to the signal lines; and a non-display level voltage supplying section for generating predetermined non-display level voltages on the signal lines. In this construction, each of the signal lines is driven by one of the impedance conversion section and the non-display level voltage supplying section on a block basis based on the partial display data.

Thus, based on the contents of the partial display data, on each block of the signal lines, the impedance conversion section drives the signal lines based on the image data or the non-display level voltage supplying section supplies predetermined non-display level voltages to the signal lines so that the non-display areas can be set in a predetermined normal color. As a result, in addition to the aforementioned effects, it is possible to contrast the display areas to be set by the partial display control.

In the embodiment, moreover, the impedance conversion section may subject the drive voltages to impedance conversion, output the impedance-converted drive voltages to signal lines of a block in which the output of the impedance conversion section is turned ON due to the partial display data and set signal lines of a block in which the output of the impedance conversion section is turned OFF due to the partial display data to a high impedance state; and the non-display level voltage supplying section can set signal lines of a block in which the output of non-display level voltage supplying section is turned ON due to the partial display data to a high impedance state and supply predetermined non-display level voltages to signal lines of a block in which the output of the non-display level voltage supplying section is turned OFF due to the partial display data.

In the embodiment, moreover, the drive voltage generating section may interrupt the generation of the drive voltages for driving signal lines of a block in which the output of the drive voltage generating section is turned OFF due to the partial display data.

Thus, based on the partial display data, it is possible to control the drive voltage generating sections on the blocks of the signal lines set in the non-display areas on a block basis. Therefore, the power consumption of the blocks of the signal lines set in the non-display areas can be effectively suppressed to promote further reduction of the power consumption by the partial display control.

In the embodiment, moreover, the electro-optical device may include pixel electrodes corresponding to the respective pixels via switching sections connecting the scan lines and the signal lines, and the non-display level voltage may set a voltage difference between voltages applied to the pixel electrodes and voltages of counter electrodes opposite to the pixel electrodes via electro-optical elements lower than a predetermined threshold value.

Thus, the non-display level voltages sets a voltage difference between the applied voltages of the pixel electrodes disposed through the switching sections connecting the scan lines and the signal lines and the voltages of the counter electrodes opposite to the pixel electrodes via the electro-optical elements. It is, therefore, possible to set the non-display area within a range in which at least the transmission factor of the pixels of the electro-optical device does not change. At last, the partial display control can be simplified independently of the precision of the non-display level voltage.

In the embodiment, moreover, the electro-optical device may include pixel electrodes corresponding to the respective pixels provided through the switching sections connecting the scan lines and the signal lines, and the non-display level voltages may be substantially equal to voltages on counter electrodes opposite to the piexel electrodes via the electro-optical elements.

Thus, the non-display level voltage is set so that the voltage difference between voltages on the pixel electrodes and the counter electrodes opposite to the pixel electrodes may be substantially 0. It is, therefore, possible to simplify the partial display control, and to stabilize the display color of the non-display area thereby to display the image having a display area of a clear contrast.

In the embodiment, moreover, the non-display level voltage may be one of the maximum and minimum gradation voltages which can be generated on the basis of the image data.

Thus, either end of the gradation voltages which can be generated in the drive voltage generating section is supplied as the voltage at the non-display level. Therefore, the user can designate the normal color of the non-display area arbitrarily to improve the facilities.

In the embodiment, moreover, each block may correspond to eight pixels.

Then, the display area and the non-display area can be set on a character-letter basis, to simplify the partial display control thereby to provide an image by an effective partial display.

According to another mode of the embodiment, moreover, the display device can comprise: a display panel including a plurality of pixels defined by a plurality of scan lines and a plurality of signal lines crossing each other; a scan drive circuit for scanning and driving the scan lines; and a signal drive circuit for driving the signal lines based on image data.

According to this mode of the embodiment, it is possible to provide a display device for realizing a low power consumption by the partial display control. A partial display of a high image quality can also be realized by applying the active matrix type liquid crystal panel, for example.

According to still another mode of the embodiment, moreover, there is provided an electro-optical device which may comprise: a plurality of pixels defined by a plurality of scan lines and a plurality of signal lines crossing each other; a scan drive circuit for scanning and driving the scan lines; and a signal drive circuit for driving the signal lines based on image data.

According to this mode of the embodiment, it is possible to provide an electro-optical device for realizing a low power consumption by the partial display control. A partial display of a high image quality can also be realized by applying the active matrix type liquid crystal panel, for example.

According to a further mode of the embodiment, moreover, there is provided a signal drive method for a signal drive circuit driving a plurality of signal lines of an electro-optical device including pixels which are defined by a plurality of scan lines and the signal lines crossing each other, comprising the steps of:

latching the image data for a horizontal scan period;

generating drive voltages for each of the signal lines based on the latched image data; and holding partial display data which indicates the propriety of the output of the drive voltages to the signal lines on a block basis, each block constituting a predetermined number of signal lines, wherein the output of the drive voltages to the signal lines is controlled per on a block basis based on the partial display data.

According to this method, the partial display can be controlled on a block basis to simplify the control circuit and to reduce the power consumption. A partial display of a high image quality can also be realized by applying the active matrix type liquid crystal panel, for example.

A preferred embodiment of the present invention will be described in detail with reference to the accompanying drawings.

1. Display Device 1.1 Construction of Display Device

FIG. 1 shows a schematic construction of a display device, to which a signal drive circuit (or a signal driver) of this embodiment is applied.

A liquid crystal device 10 as a display device includes: a liquid crystal display (LCD) panel 20; a signal driver (or a signal driving circuit, or a source driver in a narrow sense) 30, a scan driver (or a scan drive circuit, or a gate driver in a narrow sense) 50, and an LCD controller 60 and a power circuit 80.

The LCD panel (or an electro-optical device in a broad sense) 20 is formed over a glass substrate, for example. Over this glass substrate, a plurality of scan lines (or gate lines in a narrow sense) $G_1$ to $G_N$ (where N indicates a natural number of 2 or more) are arrayed in a Y-direction and extending individually in an X-direction; and a plurality of signal lines (or source lines in a narrow sense) $S_1$ to $S_M$ (where M indicates a natural number of 2 or more) are arrayed in the X-direction and extending individually in the Y-direction. At the cross point between the scan line $G_n$ ($1 \leqq n \leqq N$, n indicates a natural number) and the signal line $S_m$ ($1 \leqq m \leqq M$, m indicates a natural number), moreover, there is disposed a TFT $\mathbf{22}_{nm}$ (or a switching section in a broad sense).

The gate electrode of the TFT $\mathbf{22}_{nm}$ is connected with the scan line $G_n$. The source electrode of the TFT $\mathbf{22}_{nm}$ is connected with the signal line $S_m$. The drain electrode of the TFT $\mathbf{22}_{nm}$ is connected with a pixel electrode $\mathbf{26}_{nm}$ of a liquid crystal capacitor (or a liquid crystal element or an electro-optical element in a broad sense) $\mathbf{24}_{nm}$.

In the liquid crystal capacitor $\mathbf{24}_{nm}$, a liquid crystal is sealed between the pixel electrode $\mathbf{26}_{nm}$ and a counter electrode $\mathbf{28}_{nm}$ so that the transmission factor of the pixel (or the liquid crystal) is changed according to the voltage applied between those electrodes.

To the counter electrode $\mathbf{28}_{nm}$, there is supplied a counter electrode voltage Vcom which is generated by the power circuit 80.

The signal driver 30 is based on the image data (or the gradation data in a narrow sense) at one horizontal scan unit, to drive the signal lines $S_1$ to $S_M$ of the LCD panel 20.

The scan driver 50 is synchronized with a horizontal synchronizing signal for one vertical scan period, to scan and drive the scan lines $G_1$ to $G_N$ of the LCD panel 20 sequentially.

In accordance with the contents which are set by a host such as a not-shown central processing section (CPU), the LCD controller 60 controls the signal driver 30, the scan driver 50 and the power circuit 80. More specifically, the LCD controller 60 sets the action mode or supplies a vertical synchronizing signal or the horizontal synchronizing signal it produces, for the signal driver 30 and the scan driver 50, and feeds the polarity inverting timing of the counter electrode voltage Vcom to the power circuit 80.

The power circuit 80 generates a voltage level necessary for driving the liquid crystal of the LCD panel 20 or the counter electrode voltage Vcom based on the reference voltage fed from the outside. These various voltage levels are fed to the signal driver 30, the scan driver 50 and the LCD panel 20. Moreover, the counter electrode voltage Vcom is fed to the counter electrodes which are opposite to the pixel electrodes of the TFTs of the LCD panel 20.

The thus-constructed liquid crystal device 10 drives the display of the LCD panel 20 in association with the signal driver 30, the scan driver 50 and the power circuit 80 based on the image data fed from the outside under the control of the LCD controller 60.

Here in FIG. 1, the liquid crystal device 10 is constructed to include the LCD controller 60 but may also be constructed by disposing the LCD controller 60 outside of the liquid crystal device 10. Alternatively, the liquid crystal device 10 can also be constructed to include a host together with the LCD controller 60.

Signal Driver

Figure 2:
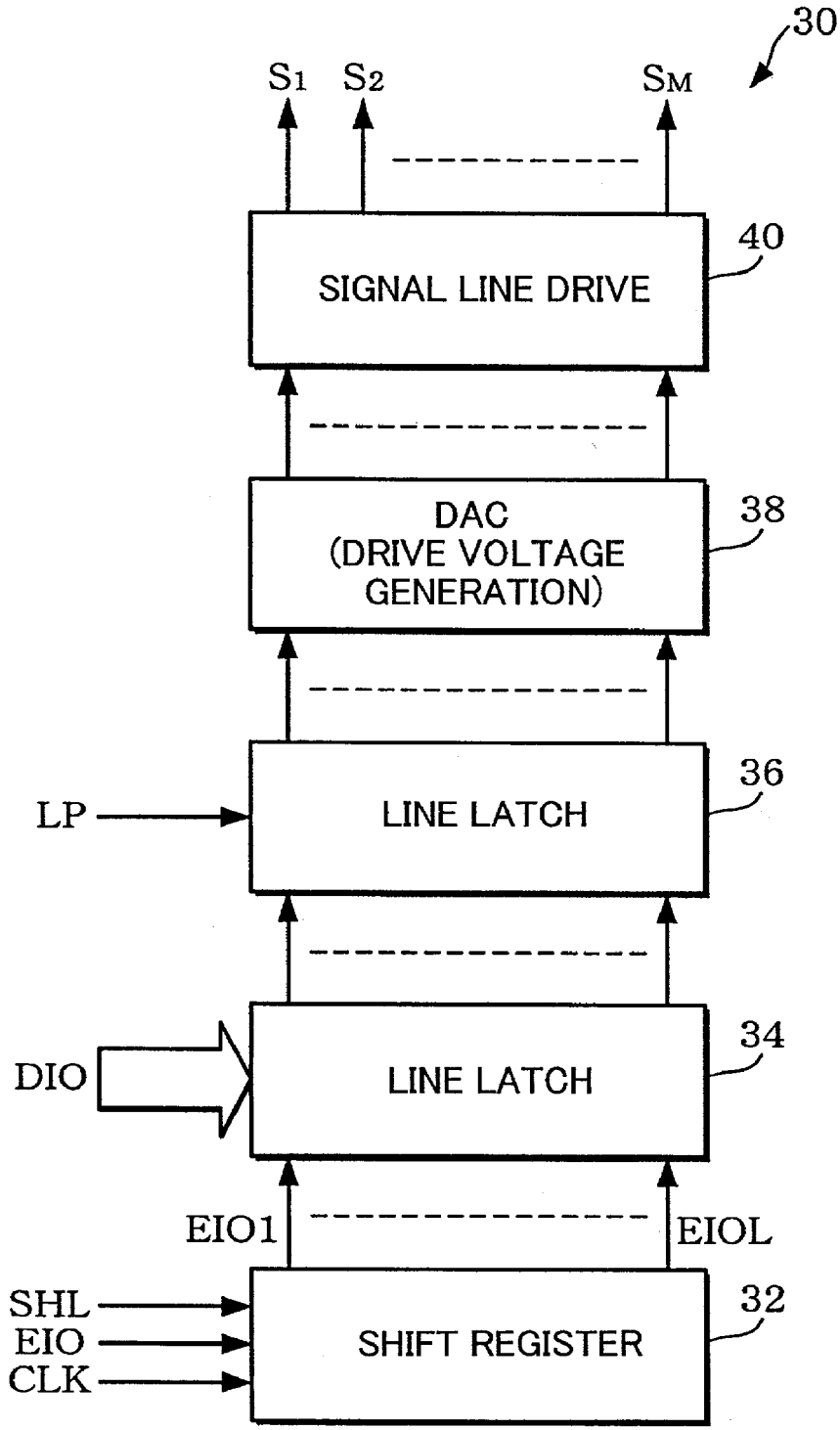
FIG. 2 is a block diagram schematically showing the construction of a signal driver shown in FIG. 1.

FIG. 2 shows a schematic construction of the signal driver shown in FIG. 1.

The signal driver 30 includes a shift register 32, line latches 34 and 36, a digital/analog converter circuit (or a drive voltage generation circuit in a broad sense) 38, and a signal line drive circuit 40.

The shift register 32 is provided with a plurality of flip-flops, which are sequentially connected. This shift register 32 shifts the enable input/output signal EIO to the adjoining flip-flops sequentially in synchronization with the clock signal CLK, when the shift register 32 holds an enable input/output signal EIO in synchronization with a clock signal CLK.

Moreover, this shift register 32 is fed with a shift direction switching signal SHL. In response to the shift direction switching signal SHL, the shift register 32 is switched between the shift direction of image data (DIO) and the input/output direction of the enable input/output signal EIO. Therefore, by switching the shift direction in response to the shift direction switching signal SHL, even if position of the LCD controller 60 for feeding the image data to the signal driver 30 is different according to the packaged state of the signal driver 30, a soft packaging is possible without increasing the area by designing the wiring lines.

The line latch 34 is fed with the image data (DIO) at the unit of 18 bits (i.e., 6 bits (of gradation data)×3 (of individual RGB colors)), for example, from the LCD controller 60. The line latch 34 latches the image data (DIO) in synchronization with the enable input/output signal EIO shifted sequentially by the individual flip-flops of the shift register 32.

In synchronization with a horizontal synchronizing signal LP fed from the LCD controller 60, the line latch 36 latches the image data of one horizontal scan unit, as latched by the line latch 34.

The DAC 38 generates the drive voltage which was made analog on the basis of the image data for each signal line.

The signal line drive circuit 40 drives the signal lines based on the drive voltage generated by the DAC 38.

This signal driver 30 fetches the image data sequentially at a predetermined unit (e.g., at the unit of 18 bits), as sequentially inputted from the LCD controller 60, and the line latch 36 latches the image data at one horizontal scan unit in synchronization with the horizontal synchronizing signal LP. Moreover, based on these signals, the individual signal lines are driven. As a result, the source electrodes of the TFTs of the LCD panel 20 are fed with the drive voltages based on the image data.

Scan Driver

Figure 3:
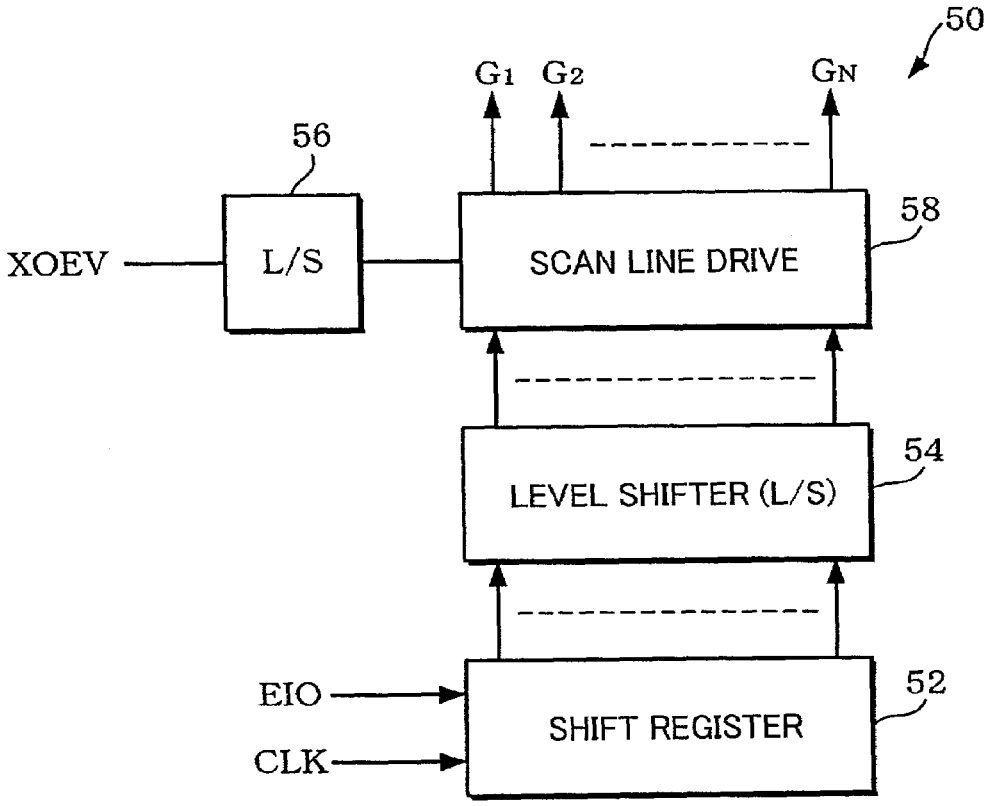
FIG. 3 is a block diagram schematically showing the construction of a scan driver shown in FIG. 1.

FIG. 3 shows a schematic construction of the scan driver shown in FIG. 1.

The scan driver 50 includes a shift register 52, level shifters (L/S) 54 and 56, and a scan line drive circuit 58.

With the shift register 52, sequentially connected flip-flops are provided to correspond to the individual scan lines. When the enable input/output signal EIO is held in the flip-flops in synchronization with the clock signal CLK, the shift register 52 shifts the enable input/output signal EIO to the adjoining flip-flops sequentially in synchronization with the clock signal CLK. The thus-inputted enable input/output signal EIO is the vertical synchronizing signal fed from the LCD controller 60.

The L/S 54 shifts a voltage level according to the liquid crystal material of the LCD panel 20 and the transistor capability of the TFTs. This voltage level has to be as high as 20 to 50 V, for example, so as to use a high breakdown process different from that of another logic circuit section.

The scan line drive circuit 58 makes a CMOS drive on the basis of the drive voltage shifted by the L/S 54. Moreover, this scan driver 50 has the L/S 56 for performing the voltage shift of an output enable signal XOEV fed from the LCD controller 60. The scan line drive circuit 58 is turned ON/OFF in response to the output enable signal XOEV shifted by the L/S 56.

In this scan driver 50, the enable input/output signal EIO inputted as the vertical synchronizing signal is shifted sequentially to each flip-flop of the shift register 52 in synchronization with the clock signal CLK. Each of the individual flip-flops of the shift register 52 is provided to correspond to each scan line so that the scan lines are sequentially selected alternatively with the pulses of the vertical synchronizing signals latched in each flip-flop. The selected scan line is driven by the scan line drive circuit 58 at the at the voltage level shifted by the L/S 54. As a result, the gate electrodes of the TFTs of the LCD panel 20 are fed with the predetermined scan drive voltage for one vertical scan period. At this time the drain electrodes of the TFTs of the LCD panel 20 are set at substantially equal potentials corresponding to the potential of the signal lines connected with the source electrodes.

LCD Controller

Figure 4:
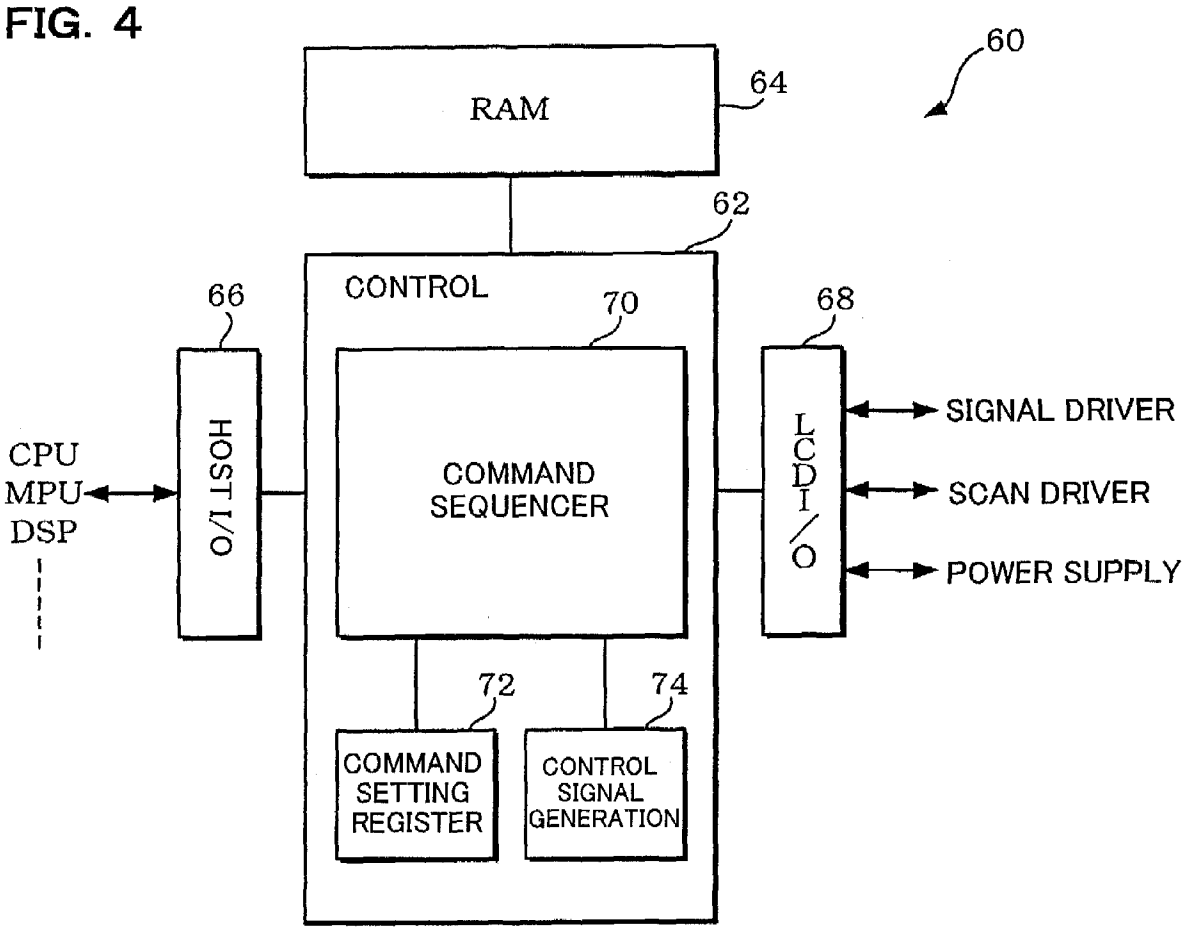
FIG. 4 is a block diagram schematically showing the construction of an LCD controller shown in FIG. 1.

FIG. 4 shows a schematic construction of the LCD controller shown in FIG. 1.

The LCD controller 60 includes a control circuit 62, a random access memory (RAM or a storage section in a broad sense) 64, a host input/output circuit (I/O) 66 and an LCD input/output circuit 68. Moreover, the control circuit 62 includes a command sequencer 70, a command setting register 72 and a control signal generating circuit 74.

In accordance with the contents set by the host, the control circuit 62 makes various action mode settings and the synchronous controls of the signal driver 30, the scan driver 50 and the power circuit 80. More specifically, in accordance with the instructions from the host, the command sequencer 70 generates synchronous timing in the control signal generating circuit 74 and sets a predetermined action mode for the signal driver or the like based on the contents set by the command setting register 72.

The RAM 64 has a function as a frame buffer for the image display and provides a work area for the control circuit 62.

This LCD controller 60 is fed with the image data and the command data for controlling the signal driver 30 and the scan driver 50 through the host I/O 66. With the host I/O 66, there is connected a CPU, a digital signal processor (DSP) or a micro processor section (MPU), although not shown.

The LCD controller 60 is fed with the image data such as still image data from the not-shown CPU and moving image data from the DSP or MPU. The LCD controller 60 is further fed from the not-shown CPU with the command data such as the contents of the register for controlling the signal driver 30 or the scan driver 50 and the data for setting the various action modes.

The image data and the command data may be fed individually through different data buses, or these data buses may be shared. In this case, the image data and the command data can be easily shared to reduce the packaging area, by making it possible to distinguish the data on the data bus between the image data and the command data, based on the signal level inputted to the command (CoMmanD: CMD) terminal.

The LCD controller 60 latches the image data, when fed, in the RAM 64 acting as the frame buffer. On the other hand, the LCD controller 60 latches the command data, when fed, in the command setting register 72 or the RAM 64.

In the command sequencer 70, various timing signals are generated by the control signal generating circuit 74 in accordance with the contents set by the command setting register 72. Moreover, the command sequencer 70 sets the mode of the signal driver 30, the scan driver 50 or the power circuit 80 through the LCD input/output circuit 68 in accordance with the contents set in the command setting register 72.

Moreover, in response to the display timing generated by the control signal generating circuit 74, the command sequencer 70 generates the image data of the predetermined type from the image data stored in the RAM 64, and feeds the generated data to the signal driver 30 through the LCD input/output circuit 68.

1.2 Inverted Drive Method

In case the liquid crystal is to be driven for the display, from the viewpoint of the durability or contrast of the liquid crystal, the charge stored in the liquid crystal capacitor needs to be discharged periodically. Therefore, in the aforementioned liquid crystal device 10 the polarities of a voltage to be applied to the liquid crystal are inverted for a predetermined period by an AC drive. The examples of the AC drive method are a frame-inverted drive method and a line-inverted drive method.

In the frame-inverted drive method, the polarities of a voltage to be applied to the liquid crystal capacitor are inverted for every frame. In the line-inverted drive method, on the other hand, the polarities of a voltage to be applied to the liquid crystal capacitor are inverted for every line. In the line-inverted drive method, too, the polarities of a voltage to be applied to the liquid crystal capacitor are inverted for the frame periods when individual lines are noted.

Figure 5A:
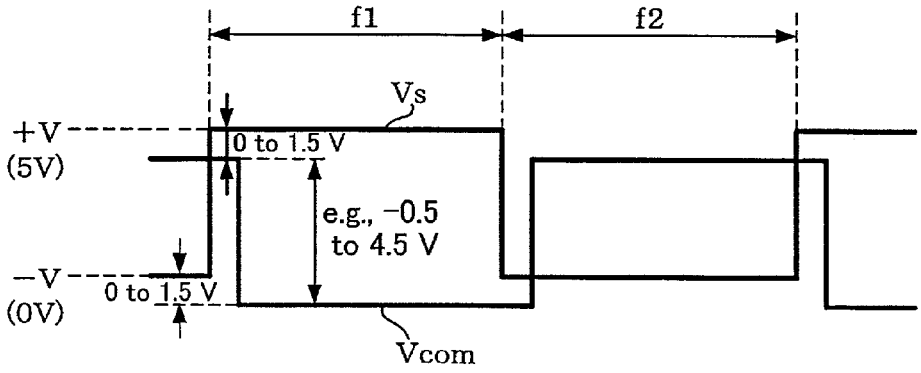
FIG. 5A is a schematic diagram showing the waveforms of a drive voltage of a signal line and a counter electrode voltage Vcom according to a frame inverted drive method.
Figure 5B:
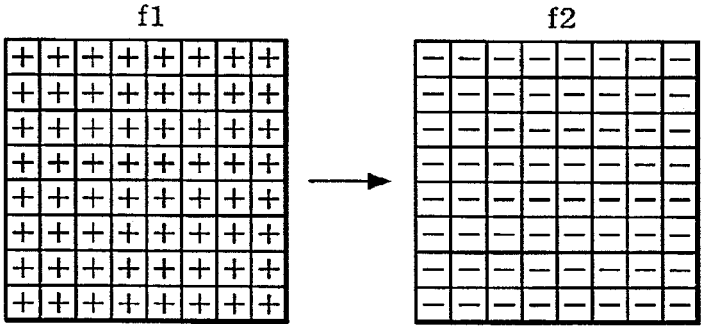
FIG. 5B is a schematic diagram showing the polarities of a voltage to be applied to liquid crystal capacitors corresponding to individual pixels for each frame when the frame inverted drive method is applied.

FIGS. 5A and 5B are diagrams for explaining the operations by the frame-inverted drive method. FIG. 5A schematically shows the waveforms of the drive voltages and the counter electrode voltages Vcom of the signal lines by the frame-inverted drive method. FIG. 5B schematically shows the polarities of a voltage to be applied to the liquid crystal capacities corresponding to individual pixels, for every frame when the frame-inverted drive method is applied.

In the frame-inverted drive method, the polarity of a drive voltage to be applied to the signal line is inverted for each frame period, as shown in FIG. 5A. Specifically, a voltage $V_s$ to be fed to the source electrode of the TFT connected with the signal line takes a positive polarity +V for a frame f1 and a negative polarity −V for a subsequent frame f2. On the other hand, the counter electrode voltage Vcom to be fed to the counter electrode opposite to the pixel electrode connected with the drain electrode of the TFT is also inverted in synchronization with the polarity inverting period of the drive voltage of the signal line.

The liquid crystal capacitor is applied with a difference between the voltages of the pixel electrode and the counter electrode so that the voltage of the positive polarity is applied for the flame f1 whereas the voltage of the negative polarity is applied for the frame f2, as shown in FIG. 5B.

Figure 6A:
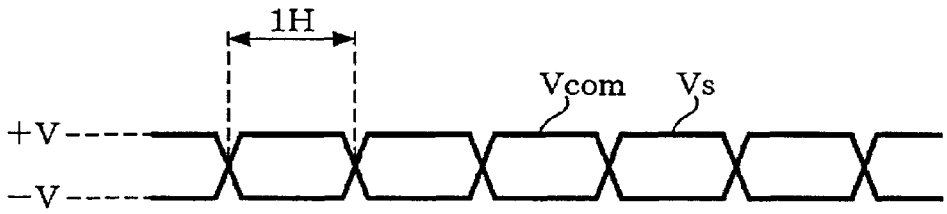
FIG. 6A is a schematic diagram showing the waveforms of a drive voltage of a signal line and a counter electrode voltage Vcom according to a line inverted drive method.
Figure 6B:
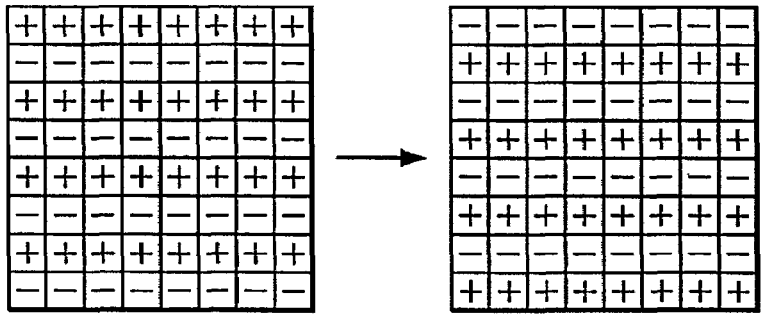
FIG. 6B is a schematic diagram showing the polarities of a voltage to be applied to liquid crystal capacitors corresponding to individual pixels for each frame when the line inverted drive method is applied.

FIGS. 6A and 6B are diagrams for explaining the actions of the line-inverted drive method.

FIG. 6A schematically shows the waveforms of the drive voltages and the counter electrode voltages Vcom of the signal lines by the line-inverted drive method. FIG. 6B schematically shows the polarities of voltages to be applied to the liquid crystal capacities corresponding to individual pixels, for every frames when the line-inverted drive method is applied.

In the line-inverted drive method, the polarity of a drive voltage to be applied to the signal line is inverted for each horizontal scan period (1H) and for one frame period, as shown in FIG. 6A. Specifically, the voltage $V_s$ to be fed to the source electrode of the TFT connected with the signal line takes the positive polarity +V for 1H of the frame f1 and the negative polarity −V for 2H. Here, the voltage $V_s$ takes the negative polarity −V for 1H of the frame f2 and the positive polarity +V for 2H.

On the other hand, the counter electrode voltage Vcom to be fed to the counter electrode opposite to the pixel electrode connected with the drain electrode of the TFT is also inverted in synchronization with the polarity inverting period of the drive voltage of the signal line.

The liquid crystal capacitor is fed with the difference between the voltages of the pixel electrode and the counter electrode so that a voltage of the polarity for each scan line is inverted to apply the voltage for the frame period, as shown in FIG. 6B.

Generally, compared to the frame-inverted drive method the line-inverted drive method makes greater contribution to improvement on the image quality but consumes more power, because of the changes for one line period.

1.3 Liquid Crystal Drive Waveforms

Figure 7:
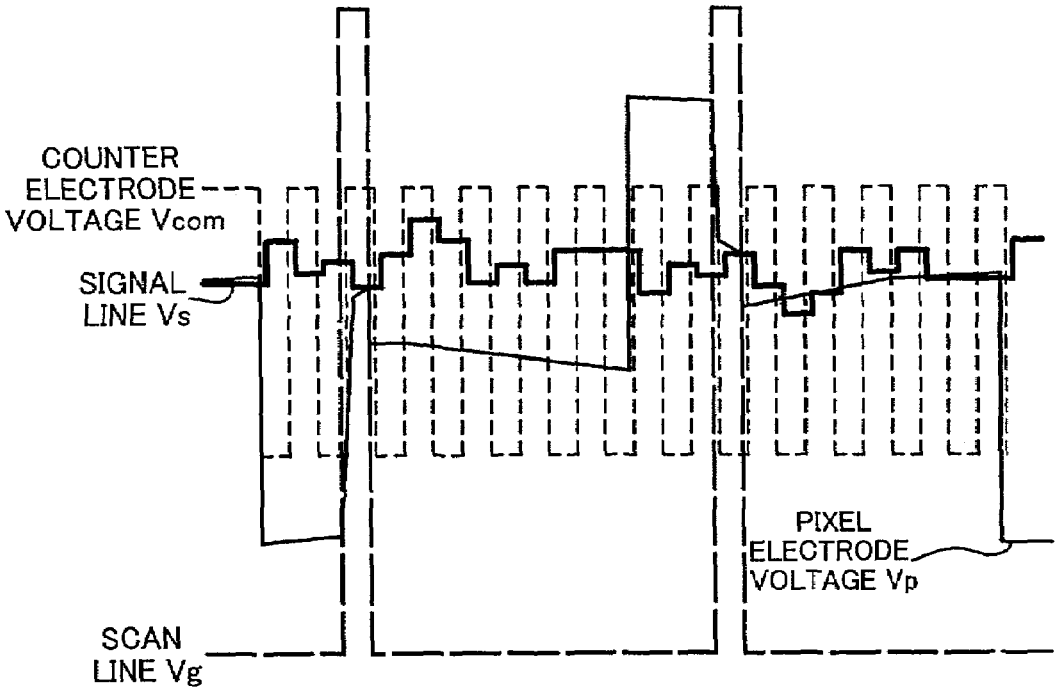
FIG. 7 is an explanatory diagram showing one example of drive waveforms of an LCD panel of a liquid crystal device.

FIG. 7 shows one example of the drive waveforms of the LCD panel 20 of the liquid crystal device 10 having the construction thus far described. Here is shown the case of driving according to the line-inverted drive method.

In the liquid crystal device 10, the signal driver 30, the scan driver 50 and the power circuit 80 are controlled according to the display timing generated by the LCD controller 60, as has been described hereinbefore. The LCD controller 60 sequentially transfers the image data to the signal driver 30 at one horizontal scan unit and feeds the horizontal synchronizing signal generated therein and a polar inverting signal POL indicating the inverted drive timing. Moreover, the LCD controller 60 feeds the vertical synchronizing signal generated therein to the scan driver 50. Moreover, the LCD controller 60 feeds a counter electrode voltage polarity inverting signal VCOM to the power circuit 80.

As a result, the signal driver 30 is synchronized with the horizontal synchronizing signal, to drive the signal line on the basis of the image data of one horizontal scan unit. The scan driver 50 is triggered by the vertical synchronizing signal scans and drives the scan lines connected with the gate electrodes of the TFTs arranged in the matrix shape in the LCD panel 20, sequentially a drive voltage Vg. The power circuit 80 feeds the counter electrode voltage Vcom generated therein to the individual counter electrodes of the LCD panel 20, while being polarity-inverted in synchronization with the counter electrode voltage polarity inverting signal VCOM.

The liquid crystal capacitor is charged with an electric charge according to the voltage Vcom between the pixel electrode connected with the drain electrode of the TFT and the counter electrode. Therefore, when a pixel electrode voltage Vp latched by the electric charge stored in the liquid crystal capacitor exceeds a predetermined threshold value $V_{CL}$, the image display becomes possible. When the pixel electrode voltage Vp exceeds the threshold value $V_{CL}$, the transmission factor of the pixel changes according to the voltage level so that the gradation expression becomes possible.

2. Signal Driver 2.1 Output Control on a Block Basis

The signal driver 30 in this embodiment may realize partial display by the signal drive based on the image data on a block basis, each block constituting a predetermined number of signal lines. Therefore, the signal driver 30 has a partial display select register to latch the partial display data indicating the propriety of output of each block on a block basis. The block, the output of which is set ON by the partial display data, is set as the display area for the signal drive based on the image data for the signal lines of the same block. On the other hand, the block, the display of which is set OFF by the partial display data, is set as the non-display area in which the predetermined non-display level voltage is fed to the signal line of that block.

In this embodiment, this block is given eight pixels. Here, one pixel is composed of three bits of RGB signals. Therefore, the signal driver 30 has one block of twenty four outputs (e.g., $S_1$ to $S_{24}$). As a result, the display area of the LCD panel 20 can be set at a character letter (of 1 byte) unit. Therefore, in an electronic device such as a mobile telephone for displaying character letters, it is possible to set an efficient display area and to display an image.

Figure 8A:
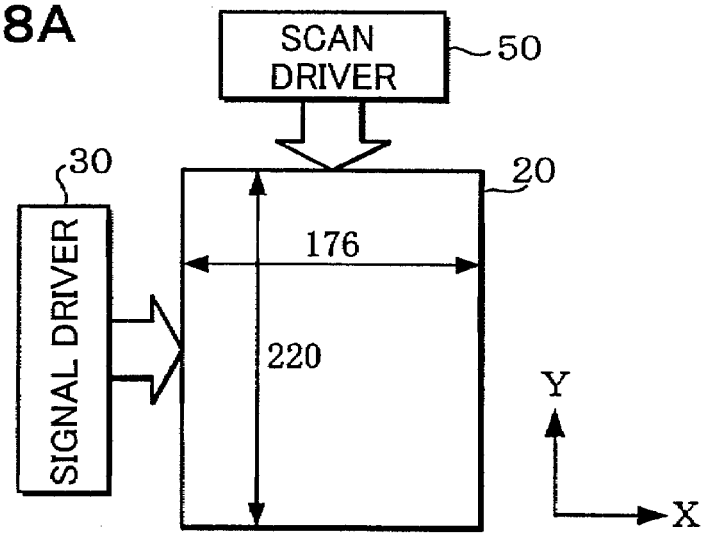
FIGS. 8A, 8B and 8C are explanatory diagrams showing one example of a partial display realized by the signal driver in the embodiment.
Figure 8B:
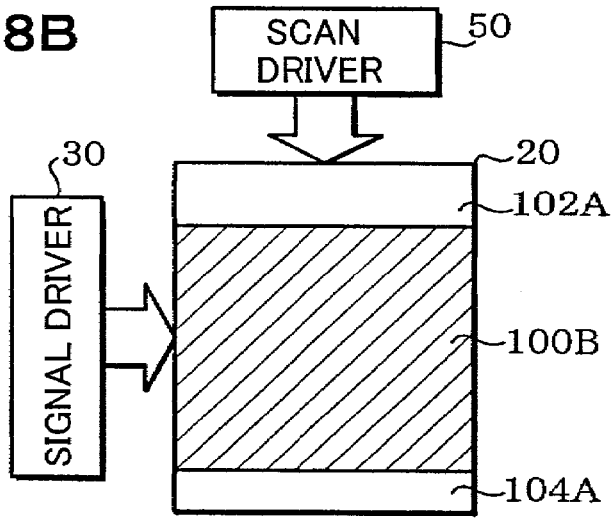
Figure 8C:
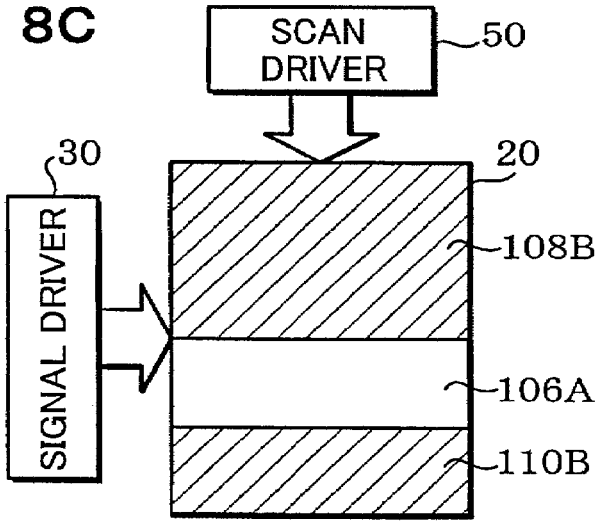

FIGS. 8A, 8B and 8C schematically show one example of the partial display which is realized by the signal driver in this embodiment.

With respect to the LCD panel 20, as shown in FIG. 8A, for example, the signal driver 30 is arranged with a plurality of signal lines being arrayed in the Y-direction, and the scan driver 50 is arranged with a plurality of scan lines being arrayed in the X-direction. In this case, a non-display area 100B is set on a block basis, as shown in FIG. 8B. Thus, only the signal lines of the blocks corresponding to display areas 102A and 104A may be drive on the basis of the image data.

Alternatively, by setting a display area 106A on a block basis, as shown in FIG. 8C, the signal lines of the blocks corresponding to non-display areas 108B and 110B need not be driven on the basis of the image data. Moreover, a plurality of non-display areas or display areas may be set in FIGS. 8B and 8C.

Figure 9A:
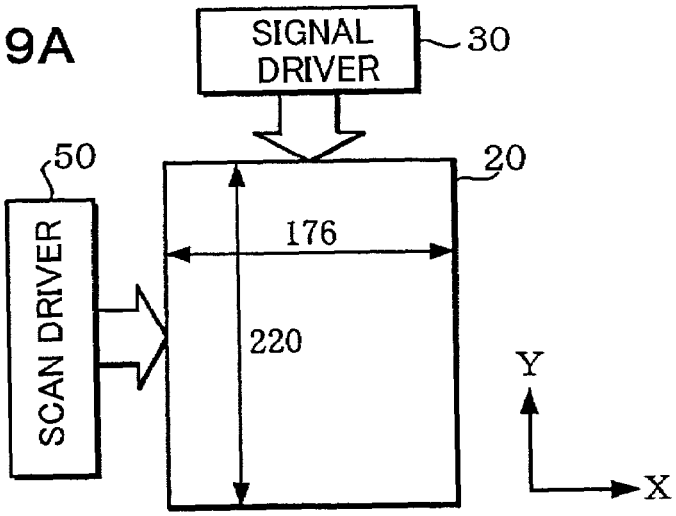
FIGS. 9A, 9B and 9C are explanatory diagrams schematically showing another example of a partial display realized by the signal driver in the embodiment.
Figure 9B:
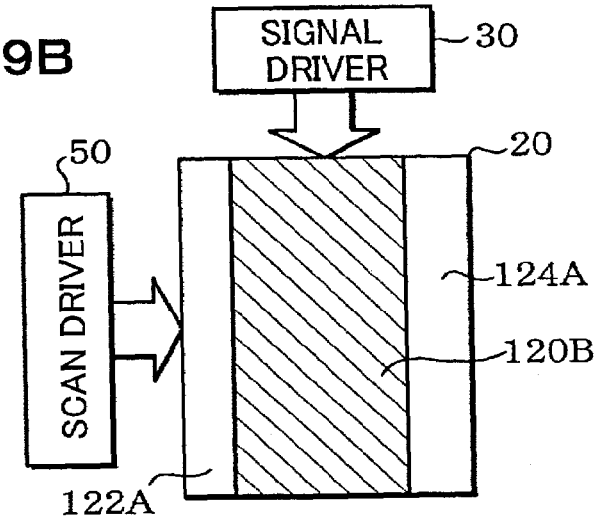
Figure 9C:
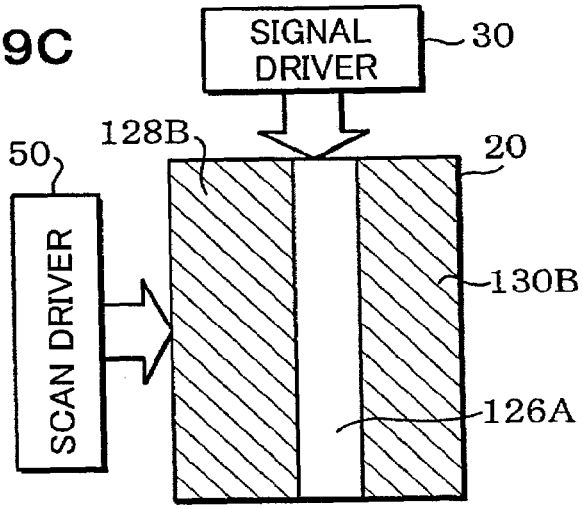

FIGS. 9A, 9B and 9C schematically show another example of the partial display which has been realized by the signal driver according to this embodiment.

In this case, with respect to the LCD panel 20, as shown in FIG. 9A, the signal driver 30 is arranged with a plurality of signal lines being arrayed in the X-direction, and the scan driver 50 is arranged with a plurality of scan lines being arrayed in the Y-direction. By setting a non-display area 120B on a block basis, as shown in FIG. 9B, only the signal lines of the blocks corresponding to display areas 122A and 124A may be driven on the basis of the image data.

Alternatively, by setting a display area 126A on a block basis, as shown in FIG. 9C, the signal lines of the blocks corresponding to the non-display areas 128B and 130B need not be driven on the basis of the image data. Here in FIGS. 9B and 9C, a plurality of non-display areas or display areas may be set.

Moreover, each display area may be divided into a still image display area and a moving image display area, for example. Thus, it is possible to provide a screen easy for the user to observe, and to lower the power consumption.

In the signal driver 30 of this embodiment, the signal line drive circuit 40 is so controlled on a block basis that the signal lines of a block are driven by a voltage-follower connected operation amplifier or a non-display level voltage supply circuit.

Figure 10A:
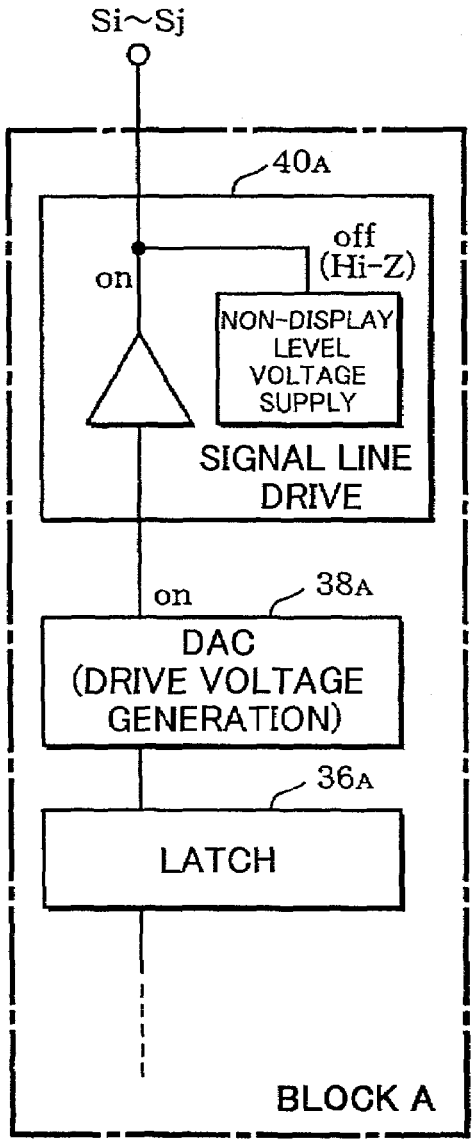
FIGS. 10A and 10B are explanatory diagrams schematically showing the control of a signal line drive circuit in the embodiment.
Figure 10B:
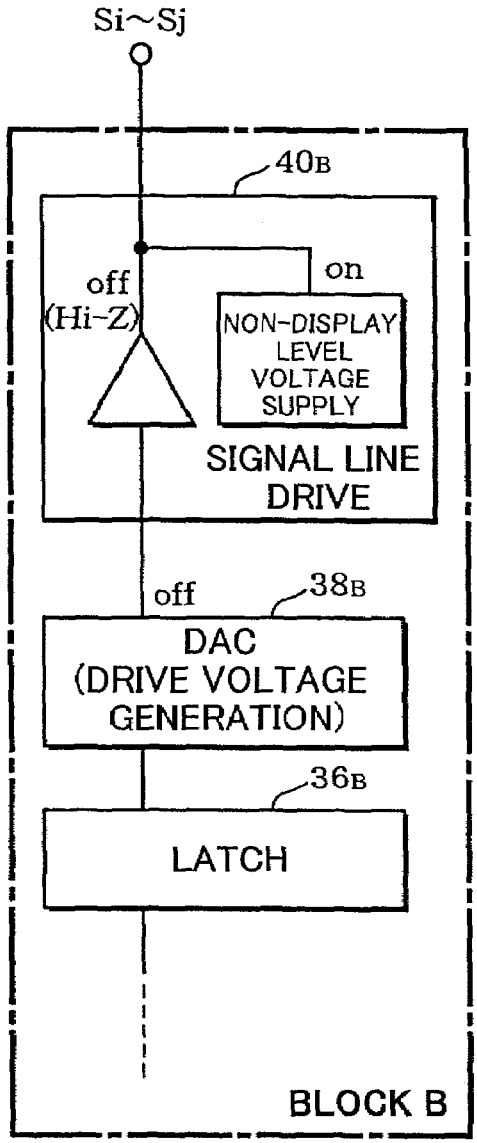

FIGS. 10A and 10B schematically show the control contents of the signal line drive circuit.

The signal lines of the block corresponding to the display area where the output is set On by the partial display data are driven on the basis of the image data. In this case, as shown in FIG. 10A, the drive voltage is generated by a DAC $\mathbf{38}_A$, and the impedance conversion is done by the voltage-follower connected operation amplifier in a signal line drive circuit $\mathbf{40}_A$, to drive one or more signal lines assigned to that block. At this time, the non-display level voltage supply circuit of the signal line drive circuit $\mathbf{40}_A$ has an output controlled in a high impedance.

For the signal lines of the block corresponding to the non-display area where the output is set OFF by the partial display data, as shown in FIG. 10B, the control of generating the drive voltage by a DAC $\mathbf{38}_B$ is interrupted, and the output of the voltage-follower connected operation amplifier in a signal line drive circuit $\mathbf{40}_B$ has an output controlled in a high impedance. Moreover, one or more signal lines assigned to that block are driven with the non-display level voltage generated by the non-display level voltage supply circuit of the signal line drive circuit $\mathbf{40}_B$. This non-display level voltage is so set that the voltage to be applied to the liquid crystal capacitor connected with the TFT may be lower than the predetermined threshold value $V_{CL}$ at which at least the transmission factor of the pixel changes to a display state.

In addition to the aforementioned effect of the image expression, therefore, the steady current consumption of the operation amplifier can be reduced to solve the problem of the prior art, that is, to reduce the power consumption of the active matrix type liquid crystal panel using the TFT liquid crystal thereby to mount the liquid crystal panel on a battery-driven mobile type electronic device.

2.2 Interchange of Blocks According to Shift Direction

The signal driver 30 in this embodiment may be arranged at different positions with respect to the LCD panel 20, as shown in FIGS. 8A to 8C and FIGS. 9A to 9C, in accordance with the electronic device in which it is packaged.

Figure 11A:
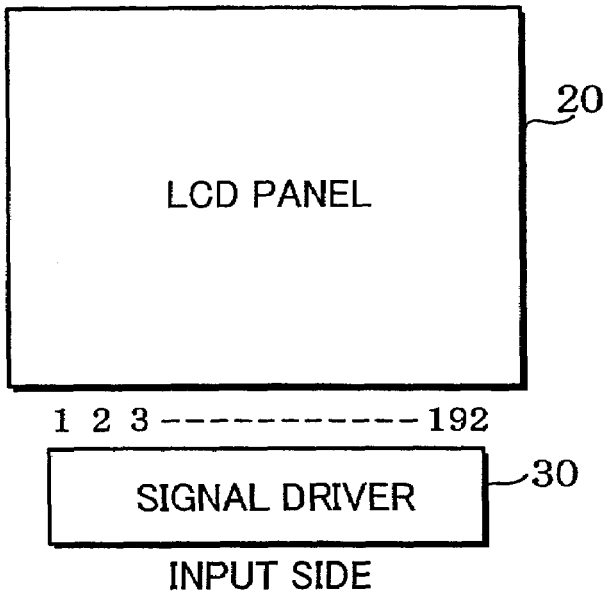
FIGS. 11A and 11B are explanatory diagrams schematically showing the signal driver to be packaged at different positions with respect to an LCD panel.
Figure 11B:
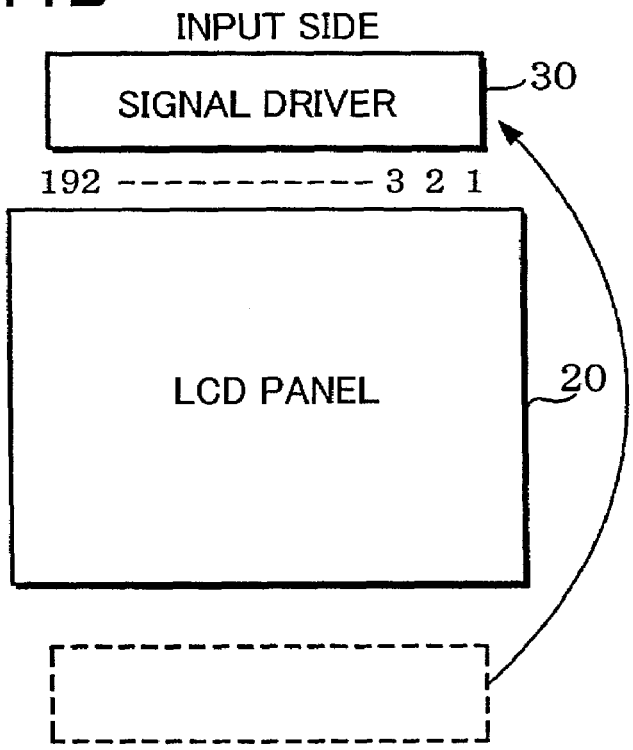

FIGS. 11A and 11B schematically show the signal driver 30 to be packaged at different positions with respect to the LCD panel 20.

Specifically in the case shown in FIG. 11A, the signal driver 30 is arranged on the lower side of the LCD panel 20. In the case shown in FIG. 11B, on the other hand, the signal driver 30 is arranged on the upper side of the LCD panel 20.

The signal driver 30 is fixed on its signal line drive output side. When the signal driver 30 is arranged on the lower side of the LCD panel 20, as shown in FIG. 11A, therefore, the order of the drive side is inverted from that at the time when the signal driver 30 is arranged on the upper side of the LCD panel 20, as shown in FIG. 11B. In dependence of the packaging state, therefore, the packaging area is enlarged for designing the wiring lines to the signal driver 30. According to the shift position switching signal SHL, therefore, the shift direction of the image data is switched.

FIGS. 12A, 12B and 12C schematically show the corresponding relations between the image data latched by the line latches and the blocks.

In case the signal driver 30 is arranged at the position shown in FIG. 11A, for example, the shift direction switching signal SHL is set to H. Then, it is assumed, as shown in FIG. 12A, that the image data, as sequentially held by the shift register and latched by the line latch 36, at one horizontal scan unit take the arrayed order of image data P1 to PM in a manner to correspond to the signal lines $S_1$ to $S_M$.

In case the signal driver 30 is arranged at the position shown in FIG. 11B, on the other hand, the shift direction switching signal SHL is set to L. Then, as shown in FIG. 12B, the image data are latched in the arrayed order of PM, . . . , P3, P2 and P1 to correspond to the signal lines $S_1$ to $S_M$ by the line latch 36 with respect to the image data fed from the LCD controller 60 in the same order as that of FIG. 12A.

For the user, however, the arrayed order of the blocks dividing a plurality of signal lines is not changed, as shown in FIGS. 12A and 12B. In case the aforementioned image data are controlled on a block basis, therefore, the user also has to control the image display while recognizing that the order array of the blocks changes according to the shift direction.

In this embodiment, therefore, the aforementioned partial display control on a block basis can be made by the user without considering the arrayed order of the blocks, as interchanged according to the shift direction. As shown in FIG. 12C, therefore, the partial display data, as being designated on a block basis, are also switched according to the shift direction. In short, the signal driver 30 in this embodiment includes a block data interchange circuit for inversely interchanging the order of the partial display data stored in the aforementioned partial display select register when the shift direction is switched.

As a result, the partial display switching on a block basis can be realized while keeping the corresponding relations between the blocks set with the display area and the non-display area and the drive circuits of an actual panel but without depending on the packaged state of the signal driver 30.

Here will be described specific constructions of the signal driver 30 according to this embodiment.

3. Specific Example of Signal Driver Construction in Embodiment 3.1 Construction of Signal Driver (on a Block Basis)

Figure 13:
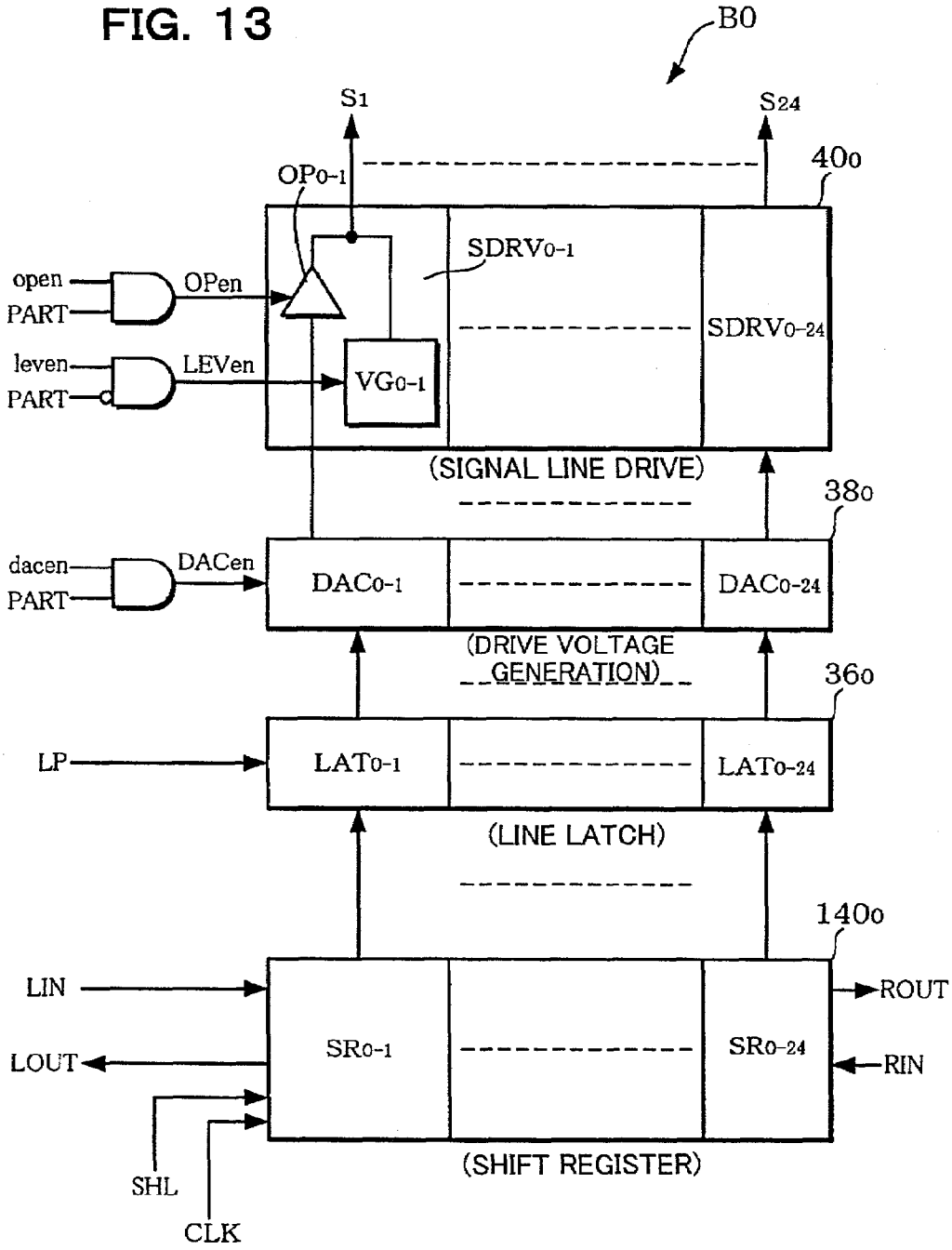
FIG. 13 is a construction diagram schematically showing a construction of a block to be controlled in the signal driver in the embodiment.

FIG. 13 schematically shows a construction of a block to be controlled in the signal driver 30 in this embodiment.

It is assumed that the signal driver 30 in this embodiment has 288 signal line outputs ($S_1$ to $S_{288}$)

Specifically, the signal driver 30 in this embodiment has 24 output terminals sections ($S_1$ to $S_{24}$, $S_{25}$ to $S_{48}$, . . . , and $S_{265}$ to $S_{288}$) provided with the construction shown in FIG. 13, to have total of twelve blocks (B0 to B11). In the description to be made in the following, FIG. 13 shows the block B0, but the remaining blocks B1 to B11 are similar.

The block B1 of the signal driver 30 includes a shift register $\mathbf{140}_0$, a line switch $\mathbf{36}_0$, a drive voltage generation circuit $\mathbf{38}_0$ and a signal line drive circuit $\mathbf{40}_0$ in a manner to correspond to each of the signal lines $S_1$to $S_{24}$.Here, the shift register $\mathbf{140}_0$ has the functions of the shift register 32 and the line latch 34, as shown in FIG. 2.

The shift register $\mathbf{140}_0$ includes $SR_{0-1}$ to $SR_{0-24}$ corresponding to the individual signal lines. The line latch $\mathbf{36}_0$ includes $LAT_{0-1}$ to $LAT_{0-24}$ corresponding to the individual signal lines. The drive voltage generation circuit $38_0$ includes $DAC_{0-1}$ to $DAC_{0-24}$ corresponding to the individual signal lines. The signal line drive circuit $40_0$ includes $SDRV_{0-1}$ to $SDRV_{0-24}$ corresponding to the individual signal lines.

3.2 Partial Display Select Register

Figure 14:
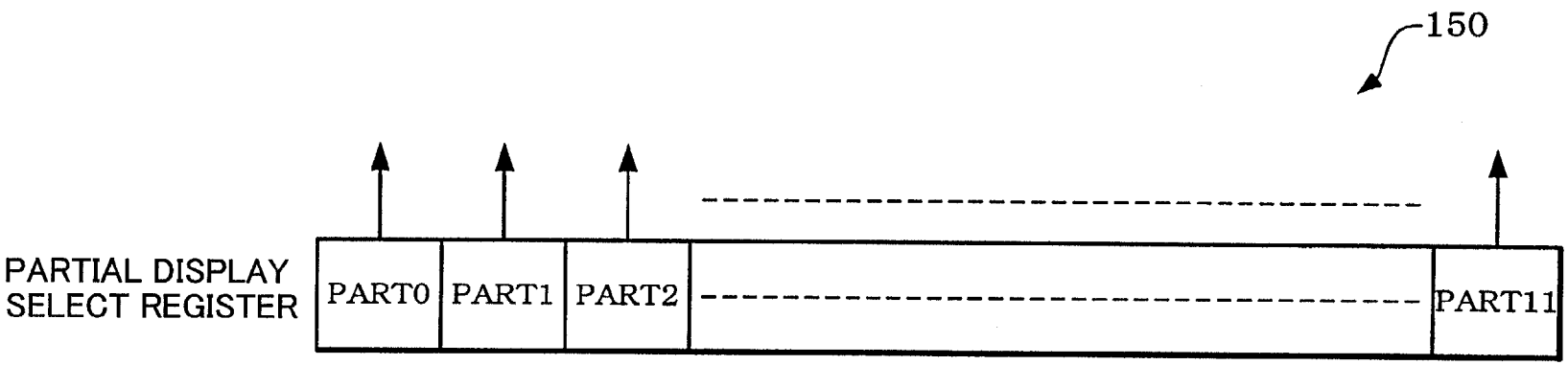
FIG. 14 is an explanatory diagram showing a partial display select register included in the signal driver in the embodiment.

As described above, the signal driver 30 in this embodiment is controlled in its output on a block basis. Therefore, the signal driver 30 in this embodiment has a partial display select register 150, as shown in FIG. 14. This partial display select register 150 is set by the LCD controller 60. The LCD controller 60 is enabled by the control from the host (CPU) to update the contents of the partial display select register 150 of the signal driver 30 at a predetermined timing, so that the optimum partial display can be realized at each time.

The partial display select register 150 includes partial display data PART0 to PART11 corresponding to the blocks B0 to B11 for indicating whether or not the signal lines of the individual locks are to be driven on the basis of the image data. In this embodiment, the display control is made on the partial display data PART0 to PART11 such that the block set at 1 indicating that the output is ON belongs to the display area, and such that the block set at 0 indicating the output is OFF belongs to the non-display area.

In order that the partial display on a block basis may be realized according to the packaged state of the signal driver 30 without demanding the user for considering the order of the blocks, as described above, the partial display data have to be switched on a block basis.

In this embodiment, therefore, the array order of the blocks of the partial display select register is switched according to the shift direction by the block data interchange circuit, as will be described in the following.

Figure 15:
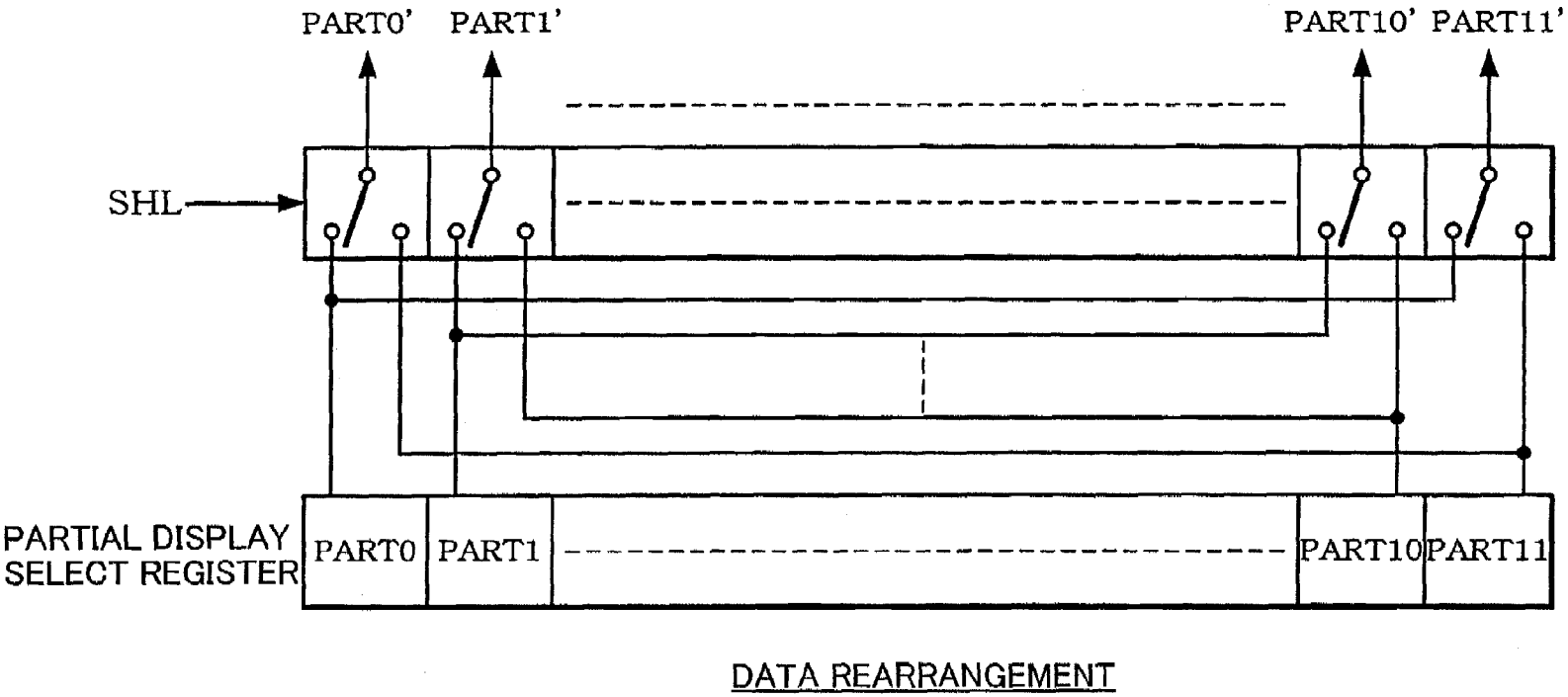
FIG. 15 is a construction diagram showing one example of the construction of a block data interchange circuit in the embodiment.

FIG. 15 shows one example of the construction of the block data interchange circuit.

In order that the partial display on a block basis may be realized according to the packaged state of the signal driver 30 without demanding the user for considering the order of the blocks, as described above, the partial display data have to be switched on a block basis.

In response to the shift direction switching signal SHL, this block data interchange circuit switches the array of the partial display data PART0 TO PART11 set in the partial display data select register. In response to the shift direction switching signal SHL, more specifically, the block data interchange circuit selects and outputs either of the partial display data PART0 AND PART11 as PART0'. In response to the sift direction switching signal SHL, too: either of the partial display data PART1 AND PART10 is selected and outputted as PART1'; either of the partial display data PART2 AND PART9 is selected and outputted as PART2'; - - - ; and either of the partial display data PART11 AND PART0 is selected and outputted as PART11'.

The partial display data PART0' to PART11' thus switched in the arrayed order on a block basis according to the shift direction are fed as the data of any of the PART0, PART1, - - - , and PART11, or PART11, PART10, - - - , and PART0 to each of the corresponding blocks B0 to B11 in accordance with the shift direction. Each of the blocks B0 to B11 makes the partial display control on the basis of the partial display data PART0' to PART11'.

In the block B0, the partial display control is made on the basis of the partial display data PART0'.

3.3 Shift Register

In synchronization with the clock signal CLK, the shift register $140_0$ of the block B0 shifts the image data, as shifted from the shift register of the adjoining block, sequentially in each SR. In response to the shift direction switching signal SHL, moreover, the shift register $140_0$ shifts the image data inputted from the adjoining block, sequentially as a leftward data input signal LIN or a rightward data input signal RIN. Here, the signals LIN and LOUT of the block B0 and the signals RIN and ROUT of the block B11 are switched in its input/output directions with the shift direction switching signal SHL.

Figure 16:
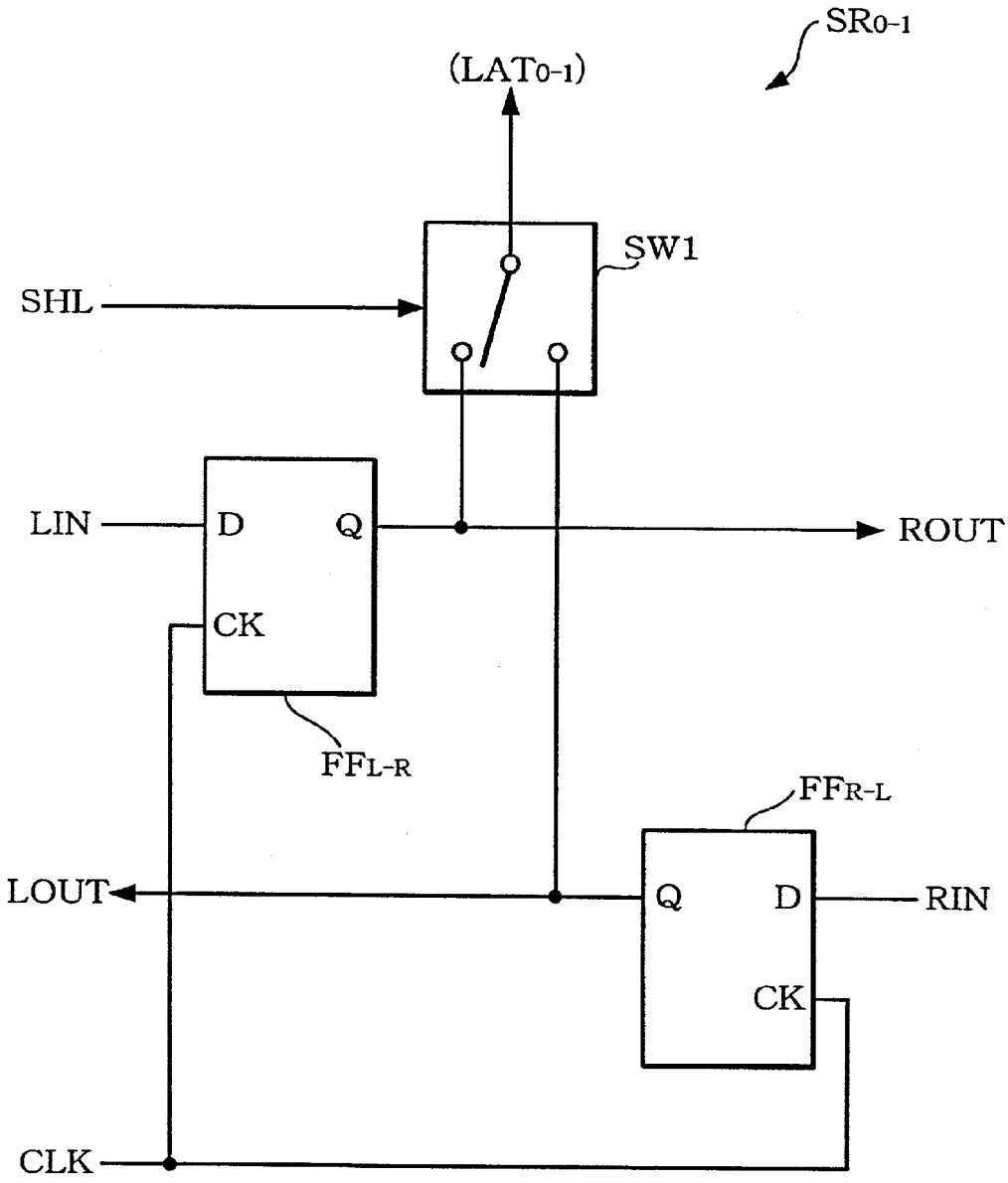
FIG. 16 is a construction diagram showing one example of the construction of an SR constructing a shift register in the embodiment.

FIG. 16 shows one example of the construction of the $SR_{0-1}$.

Here is shown the construction of the $SR_{0-1}$, but the remaining $SR_{0-2}$ to $SR_{0-24}$ can also be likewise constructed.

The $SR_{0-1}$ includes $FF_{L-R}$, $FF_{R-L}$ and SW1.

The $FF_{L-R}$ latches the leftward data input signal LIN inputted to the D-terminal, for example, in synchronization with the rising edge of the clock signal inputted to the CK terminal, and feeds the leftward data input signal LIN as the rightward data output signal ROUT from the Q-terminal to the D-terminal of the $SR_{0-2}$.

The $FF_{R-L}$ latches the rightward data input signal RIN inputted to the D-terminal, for example, in synchronization with the rising edge of the clock signal inputted to the CK terminal, and outputs the leftward data output signal LOUT from the Q-terminal.

The rightward data output signal ROUT outputted from the Q-terminal of the $FF_{L-R}$ and the leftward output signal LOUT outputted from the Q-terminal of the $FF_{R-L}$ are also fed to the SW1. In response to the shift direction switching signal SHL, the SW1 selects either of the rightward data output signal ROUT and the leftward output signal LOUT outputted from the Q-terminal of the $FF_{R-L}$, and feeds the selected one to the $LAT_{0-1}$ of the line latch $36_0$.

Thus, the image data held in the individual $SR_{0-1}$ to $SR_{0-24}$ of the shift transistor $140_0$ are latched in the individual $LAT_{0-1}$ to $LAT_{0-24}$ of the line latch $36_0$ in synchronization with the horizontal synchronizing signal LP.

3.4 Line Latch

The image data latched in the line latch $LAT_{0-1}$ and corresponding to the signal line $S_1$ are fed to the $DAC_{0-1}$ of the drive voltage generation circuit. When a DAC enable signal DACen is at the logic level H, the $DAC_{0-1}$ generates gradation levels of 64 levels on the basis of the gradation data (or image data) of 6 bits, for example, fed from the $LAT_{0-1}$.

3.5 Drive Voltage Generation Circuit

Figure 17:
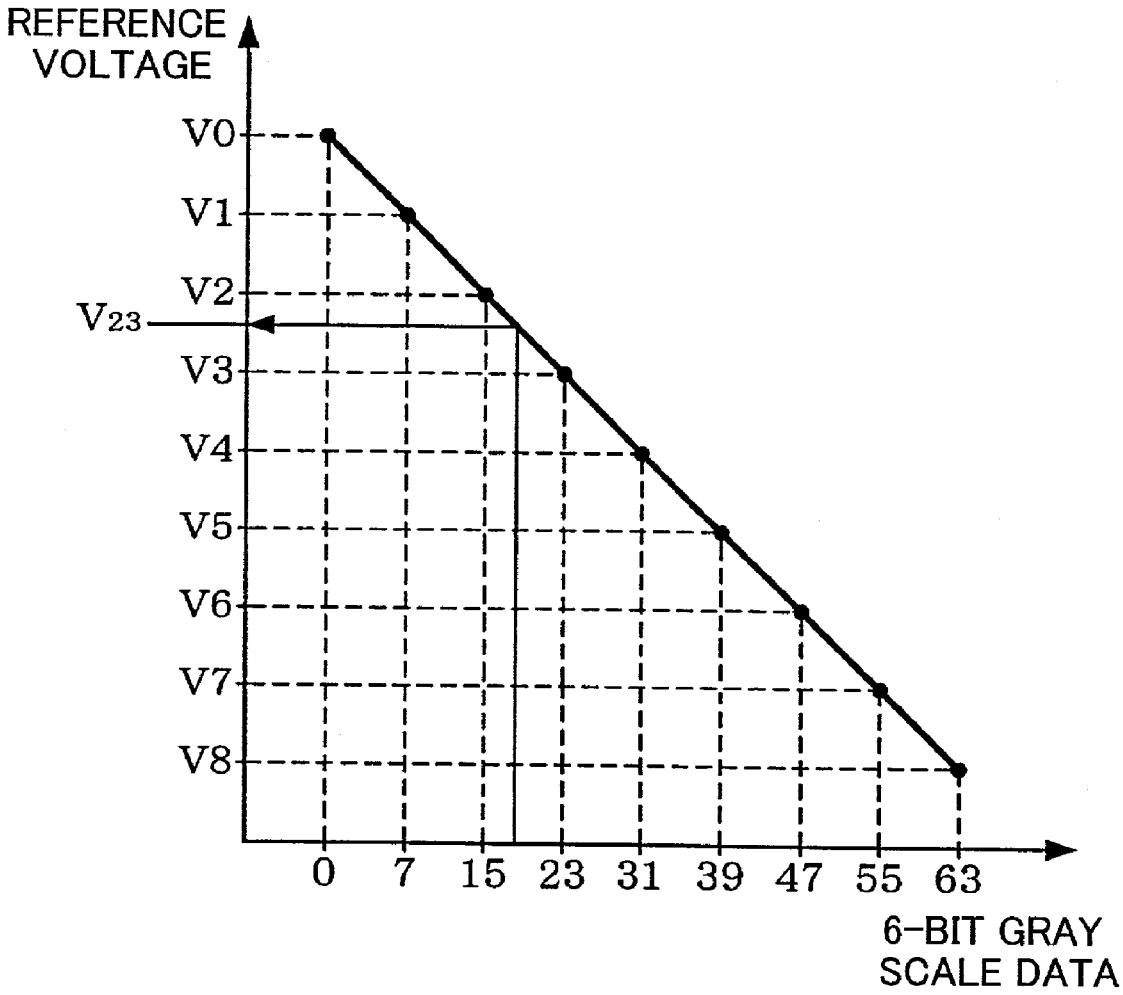
FIG. 17 is an explanatory diagram for explaining a gradation voltage to be generated by a DAC in this embodiment.

FIG. 17 is a diagram for explaining the gradation voltage generated by the $DAC_{0-1}$.

The $DAC_{0-1}$ is fed from the power circuit 80 with the reference voltages at individual levels V0 to V8. When the DAC enable signal DACen takes the logic level H, the $DAC_{0-1}$ selects one of the voltage ranges which are divided with V0 to V8 from the more significant 3 bits, for example, of the gradation data of 6 bits as the image data of the individual signal lines. If a voltage between the reference voltages V2 and V3 is selected, for example, the voltage selected is $V_{23}$ or any of 8 levels between the voltages V2 and V3 which are specified by the less significant 3 bits of the gradation data of 6 bits.

Thus, the drive voltage selected by the $DAC_{0-1}$ corresponding to the signal line $S_1$ is fed to the $SDRV_{0-1}$ of the signal line drive circuit $40_0$. Likewise, the drive voltages are fed to the remaining signal lines $S_2$ to $S_{24}$.

In this embodiment, the DAC enable signal DACen is generated by an OR between a DAC control signal dacen generated in the not-shown control circuit of the signal driver 30 and the partial display data PART (PART0') indicating the propriety of the partial display of the block B0 of the partial display select register. In short, the DAC action is done only in the setting case as the partial display area, but the DAC action is interrupted to reduce the consumption of the current to flow through a ladder resister in the setting case as the partial non-display area.

Here, this DAC enable signal DACen is likewise fed to the $DAC_{0-2}$ to $DAC_{0-24}$ corresponding to the remaining signal lines $S_2$ to $S_{24}$ so that the action controls of the DAC are made on a block basis.

3.6 Signal Drive Circuit

The $SDRV_{0-1}$ of the signal line drive circuit $\mathbf{40}_0$ includes a voltage-follower connected operation amplifier $OP_{0-1}$ as the impedance conversion section, and a partial non-display level voltage supply circuit $VG_{0-1}$.

3.6.1 Operation Amplifier

The voltage-follower connected operation amplifier $OP_{0-1}$, is negatively fed back at its output terminal and has a remarkably high input impedance so that the input current hardly flows. When the operation amplifier enable signal OPen is at the logic level H, moreover, the drive voltage generated by the $DAC_{0-1}$ is subjected to an impedance conversion to drive the signal line $S_1$. As a result, the signal drive can be made independently of the output load of the signal line $S_1$.

In this embodiment, the operation amplifier enable signal OPen is generated by an OR between an operation amplifier control signal open generated by the not-shown control circuit of the signal driver 30 and the partial display data PART (PART0') indicating the propriety of the partial display of the block B0 of the partial display select register. In short, the impedance conversion is done to drive the signal lines only in the setting case as the partial display area, but the operation amplifier action is interrupted to interrupt the current source thereby to reduce the consumption of the current in the setting case as the partial non-display area.

Figure 18:
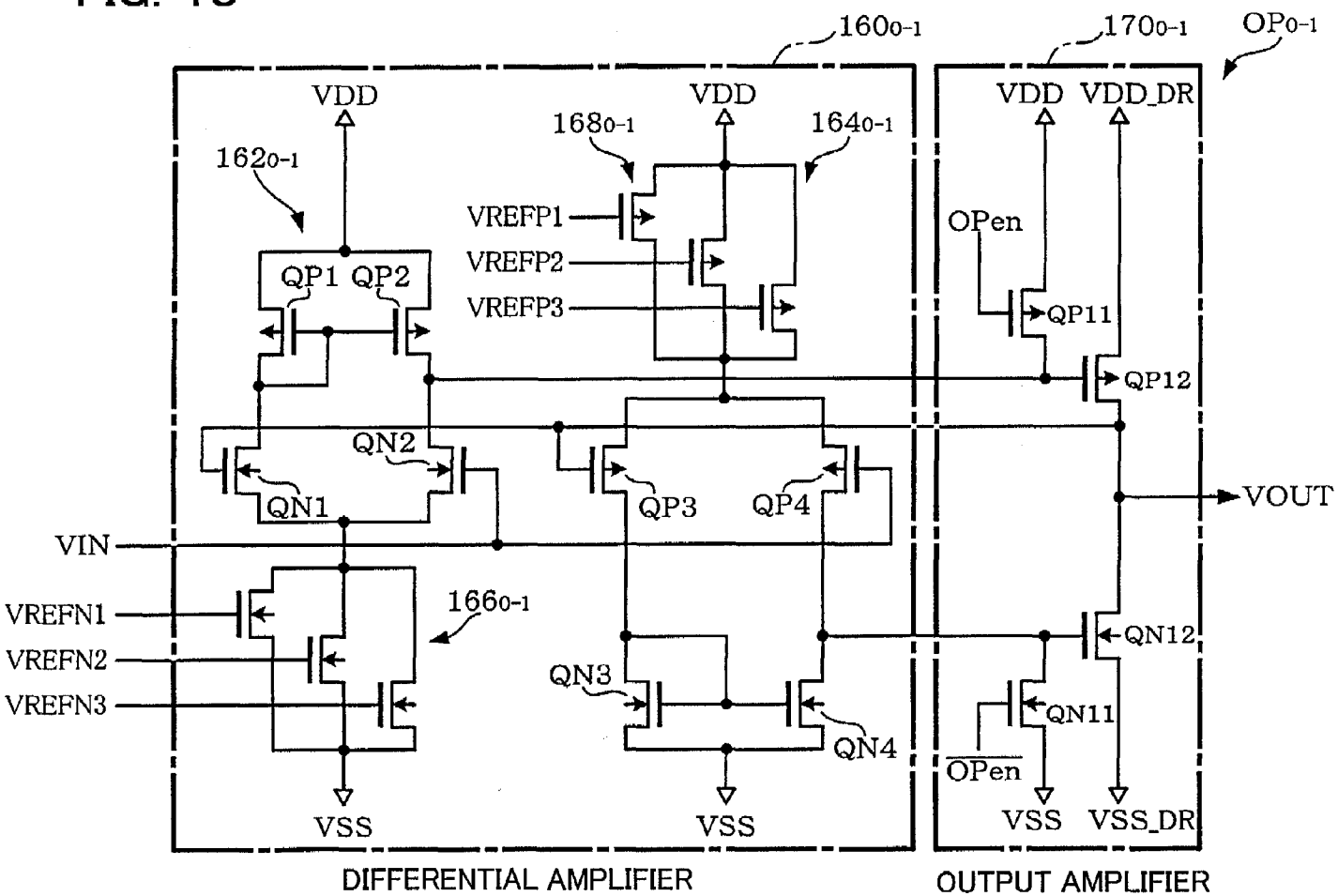
FIG. 18 is a circuit construction diagram showing one example of the construction of a voltage-follower connected operation amplifier OP in the embodiment.

FIG. 18 shows one example of the construction of the voltage-follower connected operation amplifier $OP_{0-1}$.

This operation amplifier $OP_{0-1}$ includes a differential amplifier section $\mathbf{160}_{0-1}$ and an output amplifier section $\mathbf{170}_{0-1}$. In accordance with the operation amplifier enable signal OPen, the operation amplifier $OP_{0-1}$ subjects an input voltage VIN fed from the $DAC_{0-1}$, to an impedance conversion, and outputs an output voltage VOUT.

The differential amplifier section $\mathbf{160}_{0-1}$ includes first and second differential amplifier circuits $\mathbf{162}_{0-1}$ and $\mathbf{164}_{0-1}$.

The first differential amplifier circuit $\mathbf{162}_{0-1}$ includes at least p-type transistors QP1 and QP2 and n-type transistors QN1 and QN2.

In the first differential amplifier circuit $\mathbf{162}_{0-1}$, the source terminals of the p-type transistors QP1 and QP2 are connected with a power voltage level VDD. Moreover, the gate terminals of the p-type transistors QP1 and QP2 are connected with each other and further with the drain terminal of the p-type transistor QP1, to make a current mirror structure. The drain terminal of the p-type transistor QP1 is connected with the drain terminal of then-type transistor QN1. The drain terminal of the p-type transistor QP2 is connected with the drain terminal of the n-type transistor QN2.

The gate terminal of the n-type transistor QN1 is fed with the output voltage VOUT so that it is negatively fed back. The gate terminal of the n-type transistor QN2 is fed with the input voltage VIN.

The source terminals of the n-type transistors QN1 and QN2 are connected with the ground level VSS through a current source $\mathbf{166}_{0-1}$ which is formed when any of reference voltage select signals VREFN1 to VREFN3 takes the logic level H.

The second differential amplifier circuit $\mathbf{164}_{0-1}$ includes at least p-type transistors QP3 and QP4 and n-type transistors QN3 and QN4.

In the second differential amplifier circuit $\mathbf{164}_{0-1}$, the source terminals of the n-type transistors QN3 and QN4 are connected with the ground level VSS. Moreover, the gate terminals of the n-type transistors QN3 and QN4 are connected with each other and further with the drain terminal of the n-type transistor QN3, to construct the current mirror structure. The drain terminal of the n-type transistor QN3 is connected with the drain terminal of the p-type transistor QP3. The drain terminal of the n-type transistor QN4 is connected with the drain terminal of the p-type transistor QP4.

The gate terminal of the p-type transistor QP3 is fed with the output voltage VOUT so that it is negatively fed back. The gate terminal of the p-type transistor QP4 is fed with the input voltage VIN.

The source terminals of the p-type transistors QP3 and QP4 are connected with the power voltage level VDD through a current source $\mathbf{168}_{0-1}$ which is formed when any of reference voltage select signals VREFP1 to VREFP3 takes the logic level L.

Moreover, the output amplifier section $\mathbf{170}_{0-1}$ includes p-type transistors QP11 and QP12 and n-type transistors QN11 and QN12.

In the output amplifier $\mathbf{170}_{0-1}$, the p-type transistor QP11 is connected at its source terminal with the power voltage level VDD and is fed at its gate terminal with the operation amplifier enable signal OPen. Moreover, the drain terminal of the p-type transistor QP11 is connected with the drain terminal of the p-type transistor QP2 and the gate terminal of the p-type transistor QP12.

The source terminal of the p-type transistor QP12 is connected with a drive voltage level VDD_DRV so that the output voltage VOUT is outputted from the drain terminal.

Moreover, the n-type transistor QN11 is connected at its source terminal with the ground level VSS and is fed at its gate terminal with the inverted signal of the operation amplifier enable signal OPen. Moreover, the drain terminal of the n-type transistor QN11 is connected with the drain terminal of the n-type transistor QN4 and the gate terminal of the n-type transistor NP12.

The source terminal of the n-type transistor QN12 is connected with a drive ground level VSS_DRV so that the output voltage VOUT is outputted from the drain terminal.

Figure 19:
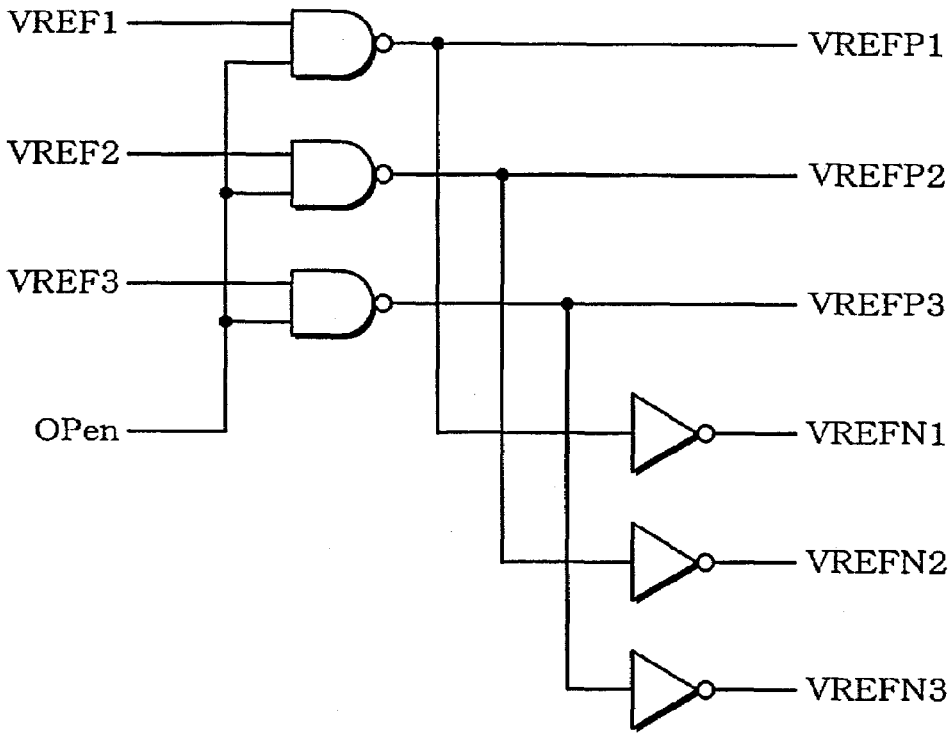
FIG. 19 is a circuit construction diagram showing one example of the construction of a circuit for generating a reference voltage select signal to be fed to first and second differential amplifier circuits of the voltage-follower connected operation amplifier OP in the embodiment.

FIG. 19 schematically shows a construction of a circuit for generating reference voltage select signals to be fed to the first and second differential amplifier circuits $\mathbf{162}_{0-1}$ and $\mathbf{164}_{0-1}$.

In this embodiment, it is possible to form a current source having an optimum current driving ability according to an output load in response to reference voltage select signals VREF1 to VREF3. For this, the reference voltage select signal generating circuit generates reference voltage select signals VREFP1 to VREFP3 for the p-type transistors and reference voltage select signals VREFN1 to VREFN3 for the n-type transistors.

At this time, when the operation amplifier enable signal OPen takes the logic level H, the current sources $\mathbf{166}_{0-1}$ and $\mathbf{168}_{0-1}$ are controlled with the p-type transistor reference voltage select signals VREFP1 to VREFP3 and the n-type transistor reference voltage select signals VREFN1 to VREFN3 in accordance with the states of the reference voltage select signals VREF1 to VREF3. When the operation amplifier enable signal OPen takes the logic level L, on the other hand, the reference voltage select signals VREF1 to VREF3 are masked. Therefore, the current sources $166_{0-1}$ and $168_{0-1}$ have no electric current to flow thereto so that they stop the differential amplifier operations.

Here will be schematically described the actions of the voltage-follower connected operation amplifier $OP_{0-1}$ thus constructed.

If the output voltage VOUT is lower than the input voltage VIN when the operation amplifier enable signal OPen takes the logic level H, the drain terminal of the n-type transistor QN2 becomes lower in the first differential amplifier circuit $162_{0-1}$, to raise the potential of the output voltage VOUT through the p-type transistor QP12.

If the output voltage VOUT is higher than the input voltage VIN, on the contrary, the drain terminal of the p-type transistor QP4 becomes higher in the second differential amplifier circuit $164_{0-1}$, to lower the potential of the output voltage VOUT through the n-type transistor QN12.

If the operation amplifier enable signal OPen takes the logic level L, on the other hand, the reference voltage select signals VREF1 to VREF3 are masked, as shown in FIG. 19. Therefore, the individual transistors of the current sources $166_{0-1}$ and $168_{0-1}$ are turned OFF, and the drain terminal of the p-type transistor QP11 is connected with the power voltage level VDD whereas the drain terminal of the n-type transistor QN11 is connected with the ground level VSS. Therefore, the output voltage VOUT comes into the high impedance state. In this case, the signal line which should be fed with the output voltage VOUT is fed with a predetermined partial non-display level voltage which is generated by the later-described partial non-display level voltage supply circuit $VG_{0-1}$.

3.6.2 Non-Display Level Voltage Supply Circuit

In case a non-display level voltage feed enable signal LEVen at the logic level H, the partial non-display level voltage supply circuit $VG_{0-1}$ generates a predetermined non-display level voltage $V_{PART-LEVEL}$ to be fed to the signal line, as shown in FIG. 13, if the non-display area (for the OFF output) is set in the aforementioned partial display select register.

Here, the non-display level voltage $V_{PART-LEVEL}$ has a following relation (1) to a predetermined threshold value $V_{CL}$ for the pixel transmission factor to change and the counter electrode voltage Vcom of the counter electrode opposed to the pixel electrode:

$$|V_{PART-LEVEL}-Vcom|<V_{CL} \quad (1).$$

Specifically, the non-display level voltage $V_{PART-LEVEL}$ takes such a voltage level that the applied voltage of the liquid crystal capacitor does not exceed the predetermined threshold value $V_{CL}$, when it is applied to the pixel electrode which is connected with the drain electrode of the TFT connected with the signal line to be driven.

Here, this non-display level voltage $V_{PART-LEVEL}$ is desired to have a voltage level equivalent to that of the counter electrode voltage Vcom, because of easy generation and control of the voltage level. In this embodiment, therefore, a voltage level fed is equivalent to that of the counter electrode voltage Vcom. In this case, the color for the OFF liquid crystal is displayed in the non-display area of the LCD panel 20.

Moreover, the non-display level supply circuit $VG_{0-1}$ in this embodiment can select and output either of the voltage levels V0 and V8 at the two ends of the gradation level voltage as the non-display level voltage $V_{PART-LEVEL}$. Here, the voltage level V0 or V8 at the two ends of the gradation voltage level is outputted alternately for every frames by the inverted drive method. In accordance with a select signal SEL designated by the user, this embodiment can select the aforementioned counter electrode voltage Vcom or the voltage level V0 or V8 at the two ends of the gradation level voltage as the non-display level voltage $V_{PART-LEVEL}$. As a result, the user can enhance the degree of freedom for selecting the color of the non-display area.

In this embodiment, the non-display level voltage feed enable signal LEVen is generated as the OR between a non-display level voltage supply circuit control signal leven generated by the not-shown control circuit of the signal driver 30 and the inversion of the partial display data PART (PART0') indicating the propriety of the partial display of the block B0 of the partial display select register. Specifically, the predetermined non-display level voltage is fed to the signal lines only in case the non-display area (for the OFF output) is set. In case the display area (for the ON output) is set, the non-display level voltage supply circuit $VG_{0-1}$ comes into the high impedance state so that the signal lines are not driven.

Here, the operation amplifier enable signal OPen and the non-display level voltage feed enable signal LEVen are also fed to the $SDRV_{0-2}$ to $SDRV_{0-24}$ corresponding to the remaining signal lines $S_2$ to $S_{24}$ so that the drive control of the signal lines is made on a block basis.

Figure 20:
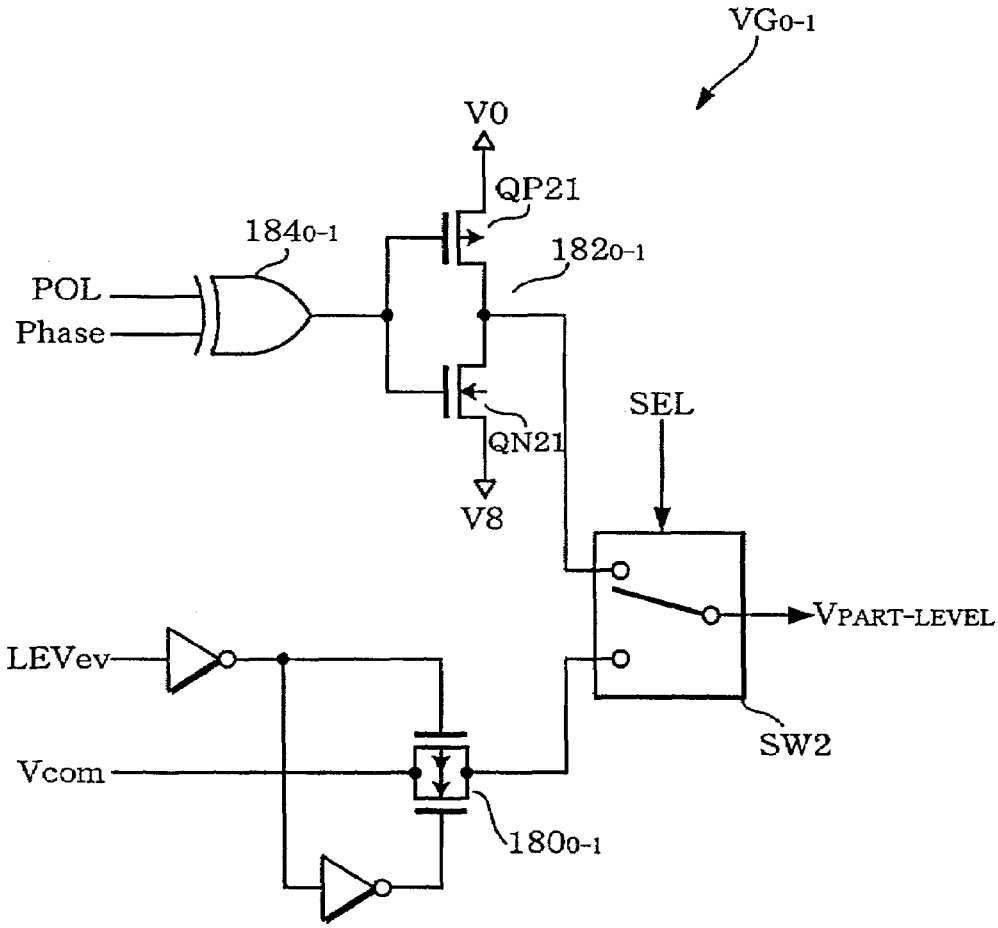
FIG. 20 is a construction diagram showing one example of the construction of a non-display level voltage supply circuit in the embodiment.

FIG. 20 shows one example of the construction of the non-display level voltage supply circuit $VG_{0-1}$ in this embodiment.

This non-display level voltage supply circuit $VG_{0-1}$ includes a transfer circuit $180_{0-1}$ for outputting the voltage Vcom equivalent to the counter electrode voltage in response to the non-display level voltage feed enable signal LEVen, an inverter circuit $182_{0-1}$ and a switch circuit SW2.

The inverter circuit $182_{0-1}$ includes an n-type transistor QN21 and a p-type transistor QP21 which have their drains connected with each other. The voltage level V8 is connected with the source terminal of the n-type transistor QN21. The voltage level V0 is connected with the p-type transistor QP21. The gate terminal of the n-type transistor QN21 and the gate terminal of the p-type transistor QP21 are connected with an XOR circuit $184_{0-1}$. The XOR circuit $184_{0-1}$ operates an exclusive OR between the polar inverting signal POL indicating the polarity inverting timing and a present phase signal Phase.

In this inverter circuit $182_{0-1}$ while being timed of the polar inverting signal POL, the logic level of the present phase signal Phase is inverted, and the voltage level V0 or V8 is fed to the switch circuit SW2.

In response to the select signal SEL, the switch circuit SW2 outputs any of the output of the transfer circuit $180_{0-1}$, the output of the inverter circuit $182_{0-1}$ and the high impedance state as the non-display level voltage $V_{PART-LEVEL}$.

3.7 Action Example

Figure 21:
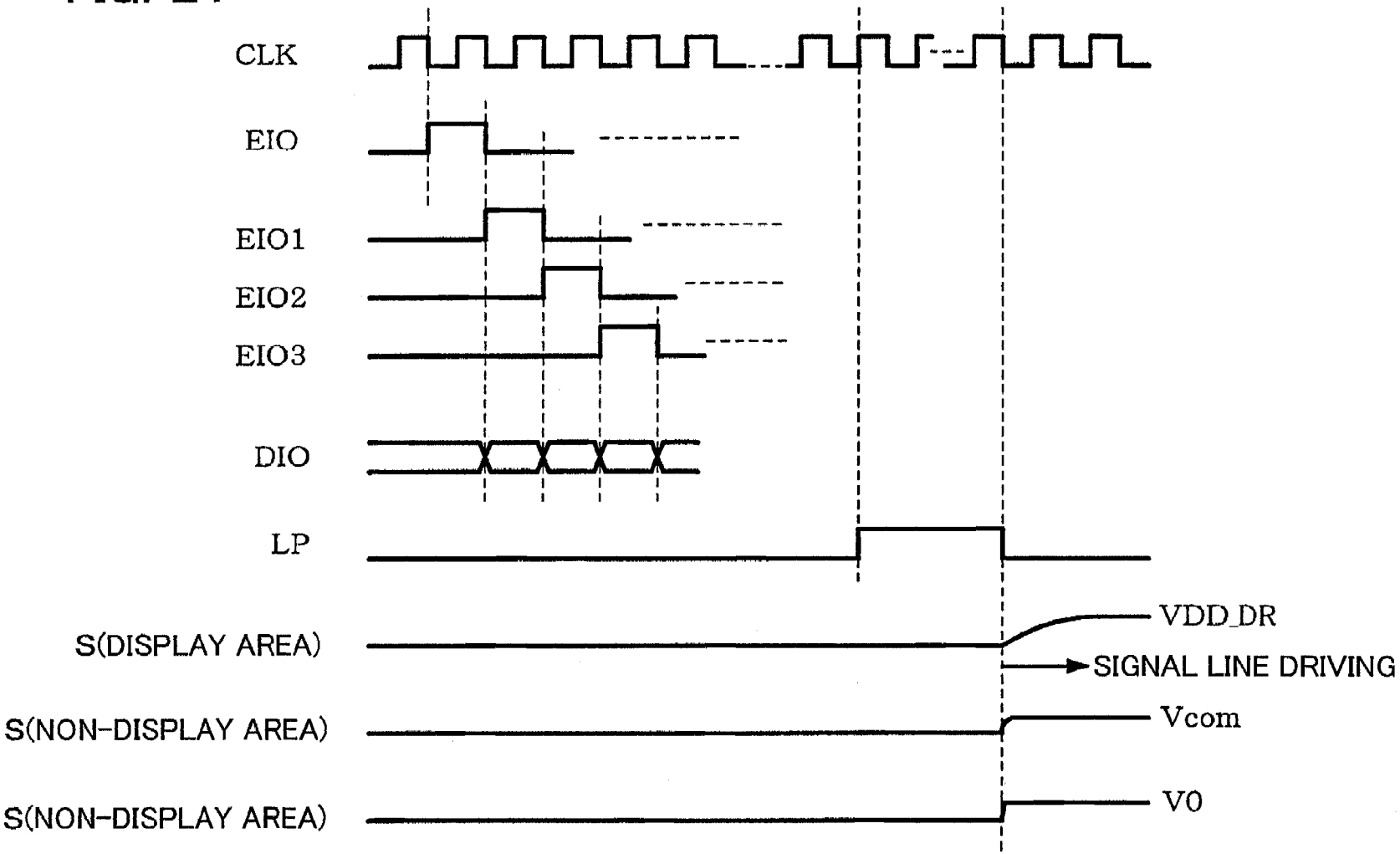
FIG. 21 is a timing diagram showing one example of the operation waveforms of the signal driver in the embodiment.

FIG. 21 shows one example of the actions of the signal driver 30 in this embodiment.

In synchronization with the clock signal CLK, the enable input/output signal EIO is shifted, and the shift register generates EIO1 to EIOL (L indicates a natural number of 2 or more). In synchronization with the individual EIO1 to EIOL, moreover, the image data (DIO) are sequentially latched by the line latch.

In synchronization with the rise of the horizontal synchronizing signal LP, the line latch 36 latches the image data at one horizontal scan unit and drives the signal line by the DAC 38 and the signal line drive circuit 40 from the fall.

In this embodiment, it is possible, as has been described hereinbefore, to select whether or not the signal line can be driven on a block basis based on the image data, and it is, therefore, possible to set the display area and the non-display area. The signal line of the block set in the display area is driven on the basis of the drive voltage generated on the basis of the gradation data. For the signal line of the block set in the non-display area, there is selected and outputted either the counter electrode voltage Vcom or one of the two end voltages of the gradation voltage level.

By using this signal driver of this embodiment, the display section of a battery-driven mobile electronic device such as a mobile telephone is enabled to make a high image quality of a high contrast and a low power consumption by a partial display compatible.

Here, the present invention should not be limited to the embodiment thus far described but could be modified in various manners within the scope thereof. For example, the invention should not be limited to the aforementioned drive of the LCD panel but can also be applied to an electroluminescence or plasma display device.

Moreover, the invention has been described on the embodiment, in which 24 adjoining outputs are divided as one block, but should not be limited thereto. One block may be more or less than 24 outputs. Moreover, no division is required for a plurality of adjoining signal lines, and the signal lines selected at a predetermined signal line interval may be handled as one block.

Still moreover, the signal driver in this embodiment should not be limited to the line inverted drive method but can be applied to the frame inverted drive method.

On the other hand, the embodiment has been constructed such that the display device includes the LCD panel, the scan driver and the signal driver, but should not be limited thereto. For example, the LCD panel may be constructed to include the scan driver and the signal driver.

Still moreover, the embodiment has been described on the active matrix type liquid crystal panel using the TFT liquid crystal, but the invention should not be limited thereto.

What is claimed is:

1. A signal drive circuit for driving a plurality of signal lines of an electro-optical device which includes a plurality of pixels defined by a plurality of scan lines and the signal lines crossing each other, based on image data comprising:

a line latch for latching the image data for a horizontal scan period;

a drive voltage generating section for generating drive voltages of the signal lines based on the image data latched by the line latch;

a signal line drive section for driving the signal lines based on the drive voltages generated by the drive voltage generating section; and a partial display data holding section for holding partial display data which indicates propriety of output of the drive voltages to the signal lines on a block basis, each block constituting a predetermined number of signal lines, wherein the signal line drive section includes:

an impedance conversion section for subjecting drive voltages generated by the drive voltage generating section to impedance conversion to output the impedance-converted drive voltages to the signal lines; and a non-display level voltage supplying section for generating predetermined non-display level voltages on the signal lines, and wherein each of the signal lines is driven by one of the impedance conversion section and the non-display level voltage supplying section on a block basis based on the partial display data.

2. The signal drive circuit according to claim 1, further comprising:

a shift register for shifting the sequentially supplied image data to supply the image data to the line latch per horizontal scan unit;

a shift direction switching section for switching shift direction of the shift register based on a predetermined shift direction switching signal; and a data interchange section for interchanging order of the partial display data which is held in the partial display data holding section on a block basis, based on the predetermined shift direction switching signal, wherein the signal line drive section controls the output of the drive voltages of the signal lines on a block basis based on the partial display data supplied from the data interchange section.

3. The signal drive circuit according to claim 1, wherein the impedance conversion section subjects drive voltages to impedance conversion, outputs the impedance-converted drive voltages to signal lines of a block when the block is set to a display area due to the partial display data and sets an output thereof to a high impedance state when the block is set to a non-display area due to the partial display data, and wherein the non-display level voltage supplying section sets an output thereof to a high impedance state when the block is set to a display area due to the partial display data and supplies predetermined non-display level voltages to signal lines of a block when the block is set to a non-display area due to the partial display data.

4. The signal drive circuit according to claim 1, wherein the drive voltage generating section interrupts generation of drive voltages for driving signal lines of a block in which output of the drive voltage generating section is turned OFF due to the partial display data.

5. The signal drive circuit according to claim 1, wherein the electro-optical device includes pixel electrodes corresponding to the respective pixels provided via switching sections connecting the scan lines and the signal lines, and wherein the non-display level voltage sets a voltage difference between voltages applied to the pixel electrodes and voltages of counter electrodes opposite to the pixel electrodes via electro-optical elements lower than a predetermined threshold value.

6. The signal drive circuit according to claim 1, wherein the electro-optical device includes pixel electrodes corresponding to the respective pixels provided via switching sections connecting the scan lines and the signal lines, and wherein the non-display level voltage is substantially equal to voltages on counter electrodes opposite to the pixel electrodes via electro-optical elements.

7. The signal drive circuit according to claim 1, wherein the non-display level voltage is one of maximum and minimum gradation voltages which is generated based on the image data.

8. The signal drive circuit according to claim 1, wherein each block corresponds to eight pixels.

9. A display device comprising:

a display panel including a plurality of pixels defined by a plurality of scan lines and a plurality of signal lines crossing each other;

a scan drive circuit for scanning and driving the scan lines; and a signal drive circuit for driving the signal lines based on image data, wherein the signal drive circuit includes:

a line latch for latching the image data for a horizontal scan period;

a drive voltage generating section for generating drive voltages of the signal lines based on the image data latched by the line latch;

a signal line drive section for driving the signal lines based on the drive voltages generated by the drive voltage generating section; and a partial display data holding section for holding partial display data which indicates propriety of output of the drive voltages to the signal lines on a block basis, each block constituting a predetermined number of signal lines, and wherein the signal line drive section includes:

an impedance conversion section for subjecting drive voltages generated by the drive voltage generating section to impedance conversion to output the impedance-converted drive voltages to the signal lines; and a non-display level voltage supplying section for generating predetermined non-display level voltages on the signal lines, and wherein each of the signal lines is driven by one of the impedance conversion section and the non-display level voltage supplying section on a block basis based on the partial display data.

10. An electro-optical device comprising:

a plurality of pixels defined by a plurality of scan lines and a plurality of signal lines crossing each other;

a scan drive circuit for scanning and driving the scan lines; and a signal drive circuit for driving the signal lines based on image data, wherein the signal drive circuit includes:

a line latch for latching the image data for a horizontal scan period;

a drive voltage generating section for generating drive voltages of the signal lines based on the image data latched by the line latch;

a signal line drive section for driving the signal lines based on the drive voltages generated by the drive voltage generating section; and a partial display data holding section for holding partial display data which indicates propriety of output of the drive voltages to the signal lines on a block basis, each block constituting a predetermined number of signal lines, and wherein the signal line drive section includes:

an impedance conversion section for subjecting drive voltages generated by the drive voltage generating section to impedance conversion to output the impedance-converted drive voltages to the signal lines; and a non-display level voltage supplying section for generating predetermined non-display level voltages on the signal lines, and wherein each of the signal lines is driven by one of the impedance conversion section and the non-display level voltage supplying section on a block basis based on the partial display data.

11. A signal drive method for a signal drive circuit driving a plurality of signal lines of an electro-optical device including pixels which are defined by a plurality of scan lines and the signal lines crossing each other, comprising the steps of:

latching the image data for a horizontal scan period;

generating drive voltages for each of the signal lines based on the latched image data;

holding partial display data which indicates propriety of output of the drive voltages to the signal lines on a block basis, each block constituting a predetermined number of signal lines;

subjecting drive voltages generated by the drive voltage generating section to impedance conversion to output the impedance-converted drive voltages to the signal lines on a block basis, when one of the blocks is set to a display area based on the partial display data; and outputting non-display level voltages from a non-display level voltage supplying section to the signal lines on a block basis, when one of the blocks is set to a non-display area based on the partial display data.

* * * * *